United States Patent [19]

Johnson

[11] 4,192,472

[45] Mar. 11, 1980

[54] CONE CRUSHER

[76] Inventor: Louis W. Johnson, 345 Palomino Dr., Eugene, Oreg. 97401

[21] Appl. No.: 897,289

[22] Filed: Apr. 17, 1978

[51] Int. Cl.[2] ..... B02C 2/04

[52] U.S. Cl. ..... 241/215; 241/216

[58] Field of Search ..... 241/207–216

[56] References Cited

U.S. PATENT DOCUMENTS

| | | | |
|---|---|---|---|
| 1,575,874 | 3/1926 | Symons | 241/215 |
| 2,017,108 | 10/1935 | Symons | 241/216 X |
| 2,224,542 | 12/1940 | Gruender et al. | 241/216 |
| 2,680,571 | 6/1954 | Bjarme | 241/215 X |
| 2,832,547 | 4/1958 | Kennedy | 241/216 X |
| 3,140,834 | 7/1964 | Symons | 241/216 |
| 3,759,453 | 9/1973 | Johnson | 241/207 |

FOREIGN PATENT DOCUMENTS

| | | | |
|---|---|---|---|
| 1066891 | 1/1954 | France | 241/215 |

*Primary Examiner*—Eugene F. Desmond

*Attorney, Agent, or Firm*—Eugene M. Eckelman

[57] ABSTRACT

A gyrating cone-shaped head cooperates with a stationary bowl support to crush rock or the like admitted into the crusher. The gyrating action of the head is accomplished by an off-set shaft arrangement for the head driven by a rotatable eccentric member. Input drive for the crusher rotatably operates the eccentric member through an independent coupler for improved gear alignment, operation and maintenance. The head has gyrating support on a dished bearing surface of the main frame, and hydrostatic pressure is admitted between the head and the frame support to minimize wear. Also, a fluid lift is provided for portions of the drive apparatus to support such parts and eliminate thrust loading caused by the weight of such parts on a radial roller bearing, thereby prolonging the useful life of the bearing. An improved seal is provided between the head and the main frame and is of a structure to remain intact and to operate effectively under all normal operating conditions of the crusher. Fluid operated apparatus is used to provide a pressure hold-down for the bowl and also fluid operated apparatus is provided for adjusting the bowl rotatably and for locking the bowl securely.

40 Claims, 28 Drawing Figures

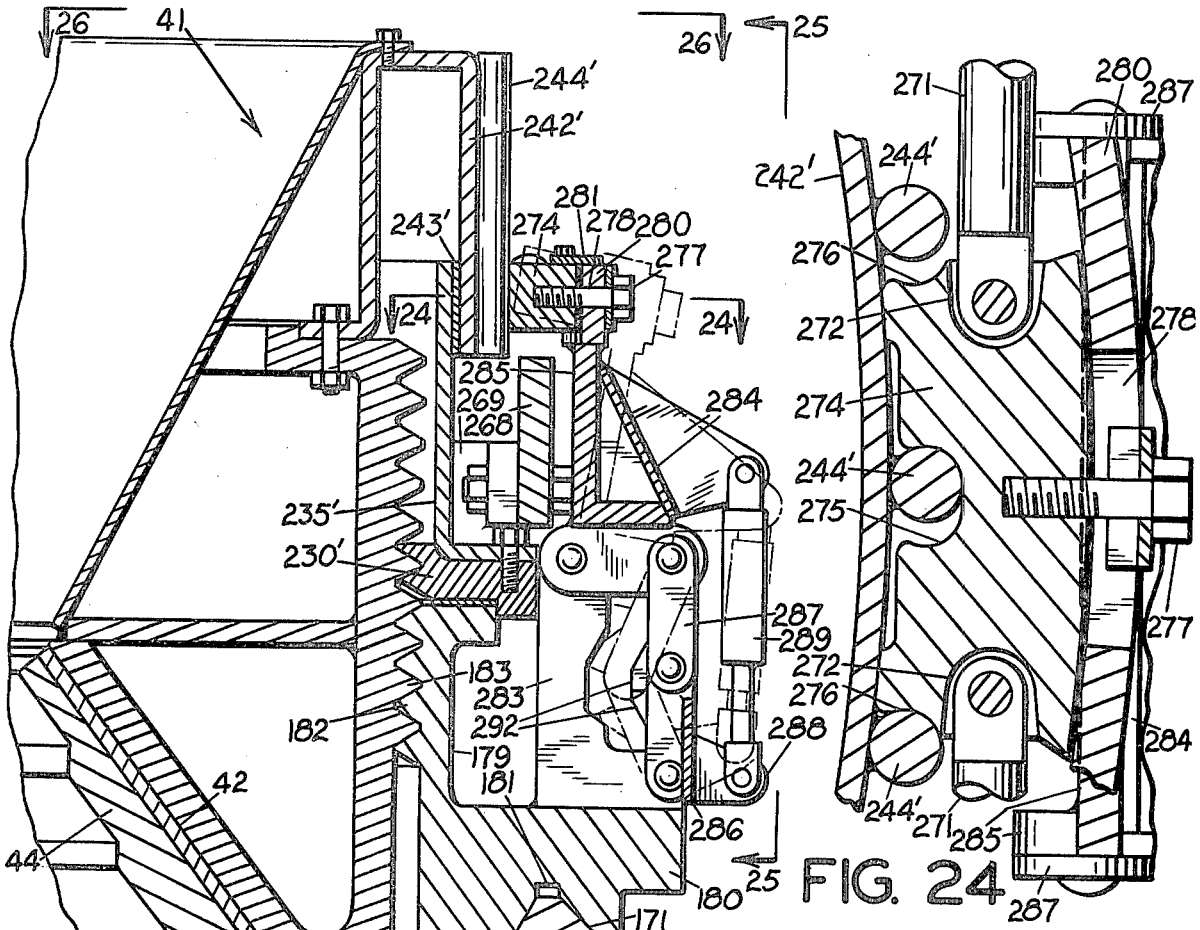
FIG. 24
FIG. 23
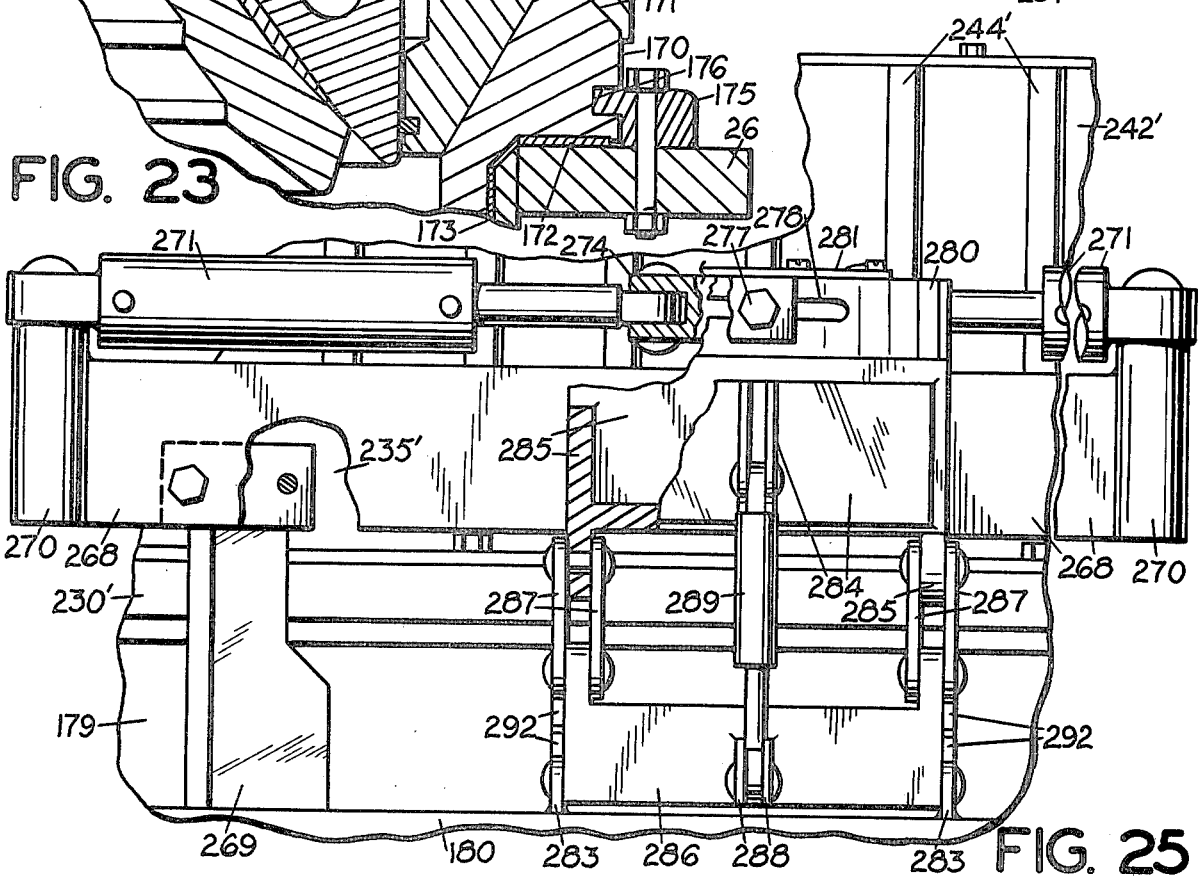
FIG. 25

CONE CRUSHER

BACKGROUND OF THE INVENTION

This invention relates to new and useful improvements in rock crushers and is particularly concerned with gyratory or cone-type crushers.

It is well known in the industry that gyratory or cone-type crushers operate under great structural strain in view of their required duty and the large drive forces necessarily imparted thereto. This type of apparatus consequently is made of heavy and rugged parts. It is desired of course that for reasons of economy in manufacture as well as for operation and maintenance, and furthermore for transportation on the road and location at the site, that this type of crusher be kept as simplified as possible, low in weight, compact in size, well balanced, and quiet. Also it is desired that it have a structural connection of parts that allows maintenance in the field. Another desirable feature of such a crusher is that it have minimum wear since the heavy and rugged parts are costly to repair or replace. Still another desirable feature is that the apparatus be readily adjustable for wear or for assembly and disassembly and that the parts be securely locked together when assembled so as to withstand the enormous shocks and stresses of crushing rock and the occasional entry of non-crushable objects.

SUMMARY OF THE INVENTION

According to the present invention and forming a primary objective thereof, a cone crusher is provided which is substantially simplified in its construction and substantially economical to manufacture and repair, which has an arrangement of parts which will withstand large structural strains and damaging forces without appreciable wear or failure, which is compact in size, well balanced and quiet, and which employs power drive means for rotatably adjusting the bowl.

In carrying out the objectives of the invention, the connection between rotating gear input and an eccentric drive is in the form of spiral bevel gears for quiet operation and great strength and an independent coupler that allows for the precise connection that such gears require as well as ready replacement of portions of the drive assembly without disturbing critical gear adjustment. Means are also used to provide fluid pressure support for the gyrating head to minimize wear, and furthermore fluid pressure lift is provided for portions of the drive connection to eliminate thrust loading of the outer radial bearing caused by the weight of the inner race of said bearing and parts mounted within the inner race. An exterior seal is provided which due to its particular construction and disposition provides effective sealing during all conditions of operation of the crusher. Fluid drive means are associated with the bowl of the crusher for adjusting it rotatably by power and for locking the bowl in a fixed position.

The invention will be better understood and additional objects and advantages will become apparent from the following description taken in connection with the accompanying drawings which illustrate preferred forms of the device.

BRIEF DESCRIPTION OF THE DRAWINGS

FIG. 23 is a view taken similar to FIG. 14 but showing a modified structural arrangement for power rotation of the bowl;

FIG. 24 is an enlarged, fragmentary sectional view taken on the line 24—24 of FIG. 23;

FIG. 25 is a fragmentary elevational view taken on the line 25—25 of FIG. 23;

DETAILED DESCRIPTION OF PREFERRED EMBODIMENTS

Figure 1:
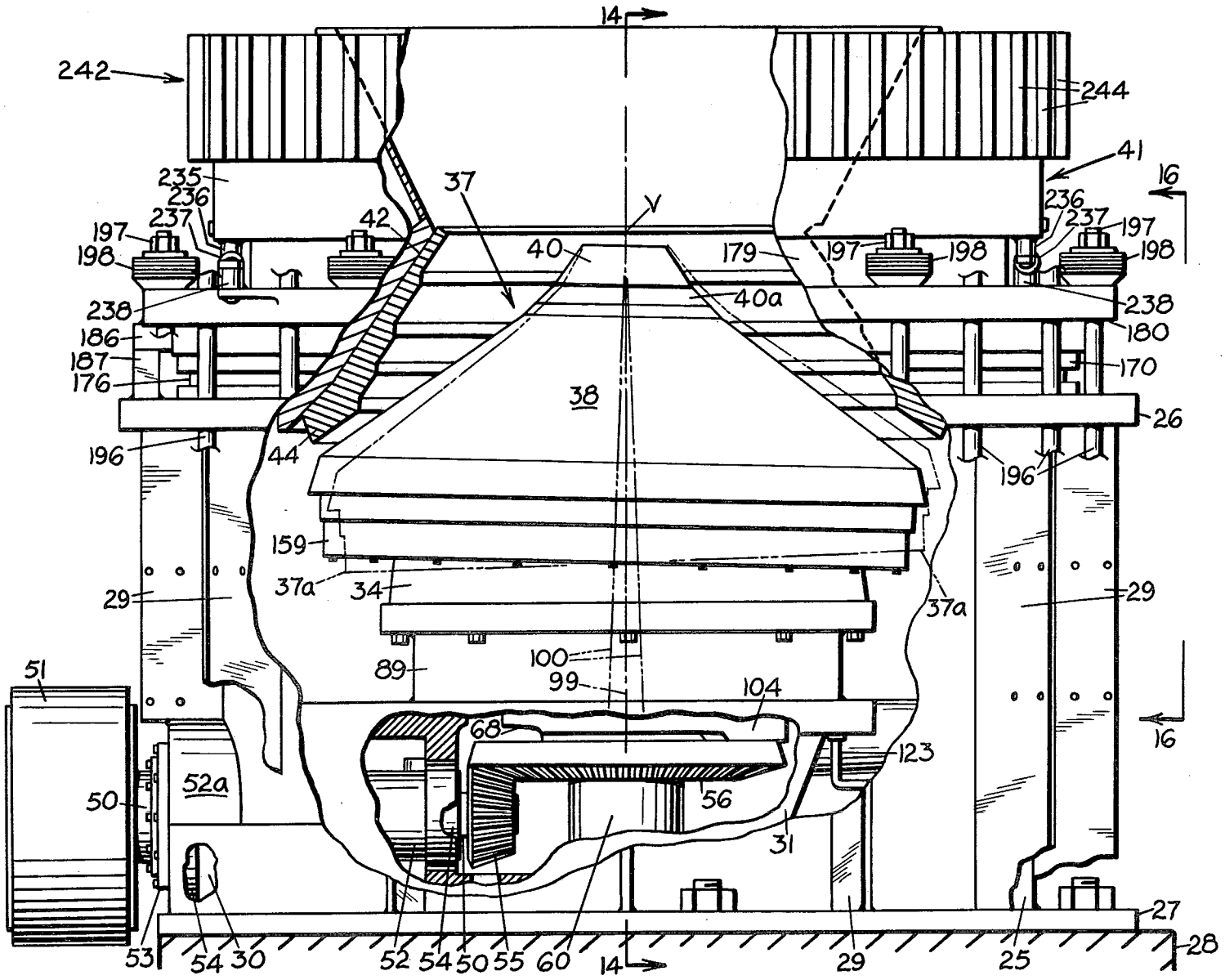
FIG. 1 is an elevational view of the present crusher, certain parts of this view being broken away to show internal parts.
Figures 14, 15:
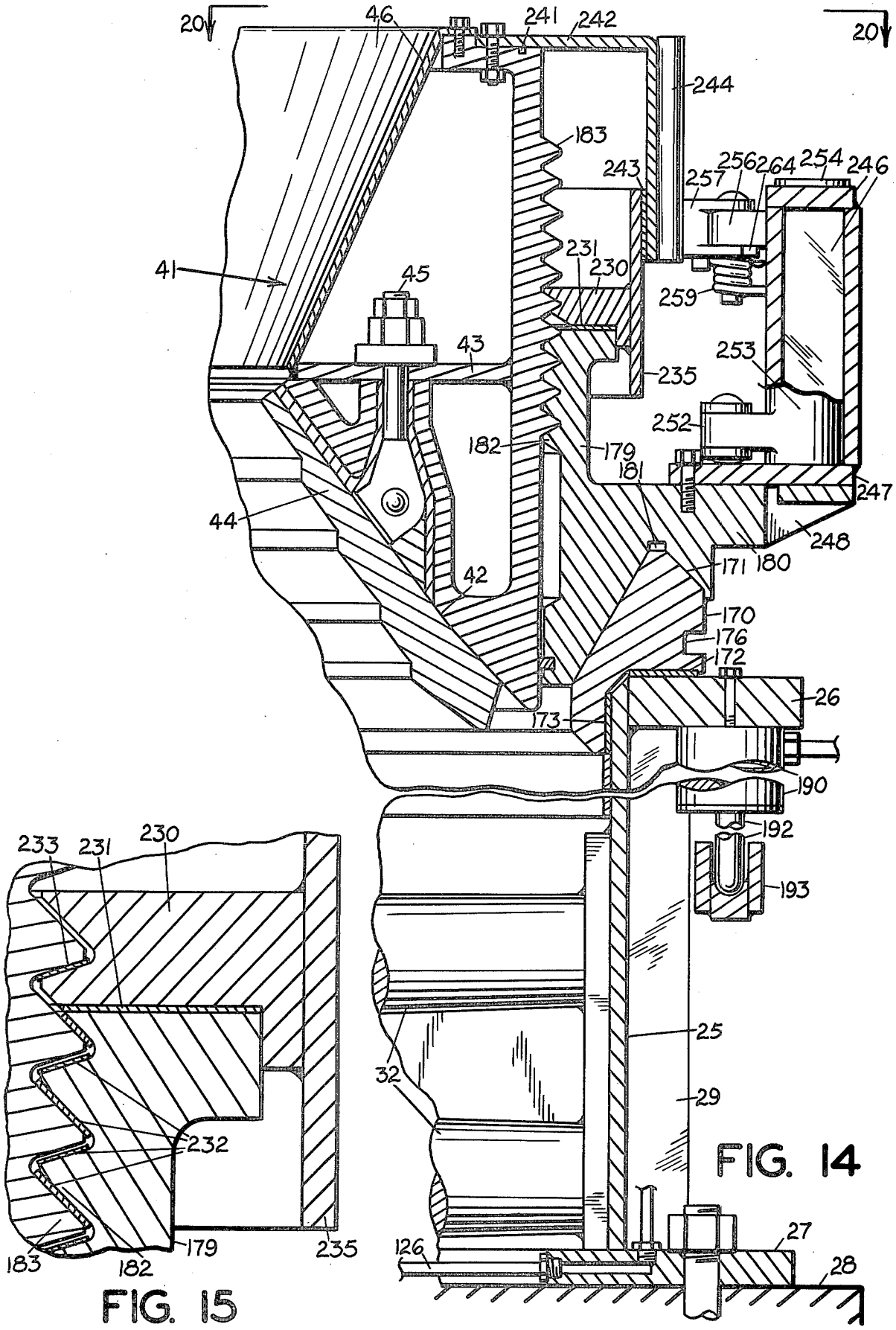
FIG. 14 is an enlarged, fragmentary, foreshortened sectional view taken on the line 14—14 of FIG. 1.
FIG. 15 is an enlarged detail view of a portion of FIG. 14.

With particular reference to the drawings and first to FIGS. 1 and 14, the crusher comprises a lower circular body frame portion 25 reinforced by an upper integral annular ring 26 and a lower integral annular ring 27. The crusher is bolted or otherwise secured to a suitable support 28. Upright reinforcing webs 29 are welded to the exterior of body portion 25 between upper reinforcing rings 26 and 27. An oil reservoir 30 is formed around the lower outer periphery of body portion 25 and flange 27 to provide good oil capacity for lubrication of the crusher. This mounting arrangement of reservoir 30 uses the body portion 25 as a heat sink.

Figure 2:
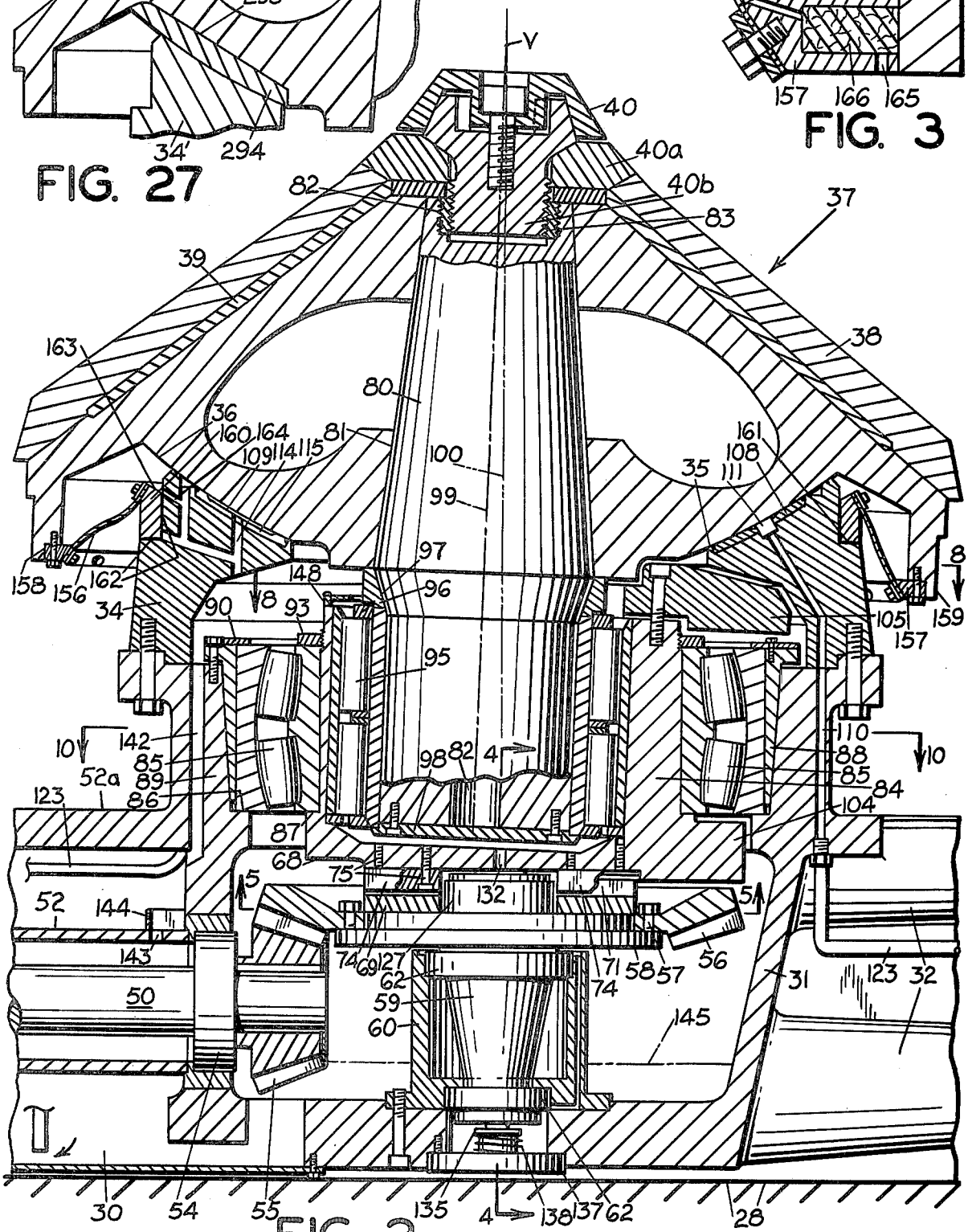
FIG. 2 is a vertical sectional view showing internal working parts of the crusher.

The main body portion of the crusher includes an internal centrally located cup-shaped frame portion 31, FIG. 2, integrated with the circular frame portion by three or more I-beam type struts 32. The upper edge of frame portion 31 has a head support or thrust member 34 in the form of a ring removably attached thereto, and this head support has a spherical or dished upper bearing surface 35 which is engaged by a bottom arcuate surface 36 on a crushing head 37 in a manner to be described more fully hereinafter. Head 37 supports mantle 38 on machined contact surfaces and by the medium of a filler layer 39 therebetween. A hold-down cap assembly 40 to be later described holds the mantle removably on the head.

With particular reference to FIGS. 1 and 14, head 37 cooperates with an annular bowl 41 having a hollow frustoconical surface 42 and having an inturned flange 43 below its upper edge which supports a liner 44 by means of eye-bolts 45 in a conventinal manner. A hopper portion 46 is removably attached to the bowl 41 and directs rocks to be crushed into the area between the gyrating head 37 and the liner 44. Rock that has been crushed falls down around the exterior of frame portion 31 and is carried away by suitable conveyor means not shown.

Figure 4:
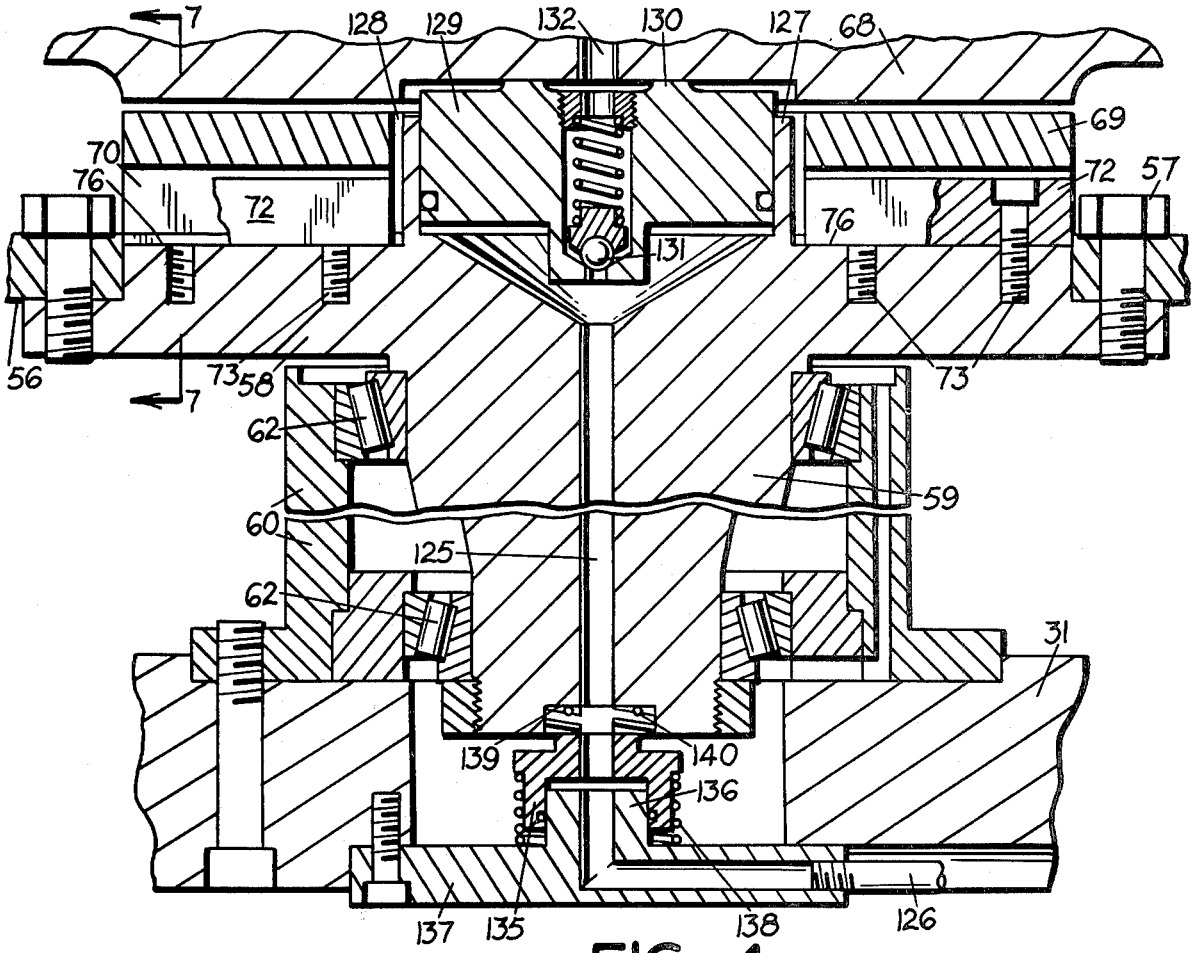
FIG. 4 is an enlarged, fragmentary sectional view taken on the line 4—4 of FIG. 2.

Input drive for the crusher comprises a shaft 50, FIGS. 1 and 2, having an outward projecting end for securement to a drive sheave 51 rotated by suitable power apparatus not shown. The shaft 50 extends through an inwardly projecting housing 52 within a larger housing 52*a*. Shaft 50 is supported by bearings 54 and housing 52 has an outside flange 53 abutted against the outer surface of housing 52*a*. This shaft and bearing assembly is installed and removed as a unit and housing 52 can be adjusted longitudinally if necessary such as by shimming. The inner end of shaft 50 has a bevel pinion gear 55 keyed or otherwise secured thereto, and this pinion gear has meshing engagement with an annular bevel gear 56, also seen in FIG. 4, removably secured to a flange 58 integral with a depending shaft 59 having journaled engagement in an annular upright housing 60 removably secured to the bottom of central frame portion 31. Journaled engagement of shaft 59 in the housing 60 is by upper and lower bearings 62.

Shaft 59 stabilizes flange 58 which drives an eccentric member 68 by means of an intermediate coupler 69, FIGS. 2 and 4–7. This coupler has a diametral groove 70 in its bottom surface and a diametral groove 71 in its top surface extending at right angles to the groove 70. A pair of spaced lugs or keys 72 are releasably secured, as by screws 73, to the upper surface of flange 58 and slidably fit in the groove 70 of the coupler. Likewise, a pair of spaced lugs or keys 74 are releasably secured, as by screws 75, to the bottom surface of eccentric member 68 and slidably fit in grooves 71. Each of the lugs 72 and 74 fits in a recess 76 in the part to which it has screw connection.

The connection provided by the coupler 69 thus comprises an independent connection between the drive gear 56 and the eccentric member 68. This independent connection, rather than comprising a direct connection between the gear and the eccentric member, accomplishes a first advantage of providing precise gear fit adjustment between the pinion gear 55 and the bevel gear 56. That is, such precise engagement can readily be accomplished if necessary by installing shims, not shown, between the flange of the bearing housing 52 and the housing 52*a* for horizontal adjustment and between the flange 58 and the gear 56 for vertical adjustment. Another advantage of the coupler 69 is that said coupler is of slightly less thickness than the spacing between the flange 58 and eccentric member 68 and such clearance accommodates any misalignment and prevents vertical binding. Furthermore, since the lugs 72 and 74 fit in recesses 76 in the parts to which they have screwed attachment, the rotating torque is taken directly by the coupler and the lugs and a shearing force is not put on the screws 73 and 75. The coupler 69 also has the advantage of simplifying accurate gear adjustment and replacement of associated parts in the field. Further yet, the coupler arrangement allows spiral bevel gears to be used, such type of gears having the advantage of being stronger and quieter than straight teeth gears.

A heavy shaft 80, FIG. 2, is fitted into an axial bore 81 in the head 37 and has association, to be described, with the eccentric member 68 for producing the gyrating action of the head. The hold-down cap assembly 40, which includes a torch ring 40*a*, has releasable engagement with the top end of the shaft for holding the mantle 38 in place. This cap is of conventional construction except for its threaded connection with the shaft 80. In this regard, the shaft has a threaded recess 82 arranged to receive a threaded bushing 83 also having internal threads for receiving a threaded shank 40*b* of cap 40. Since the outer threads on bushing 83 are stronger than the internal threads of said bushing because of their larger size, any failure of connection between the cap and the shaft will occur in the inner threads, thus eliminating damage to the shaft and usually only requiring a replacement of the bushing.

Figure 8:
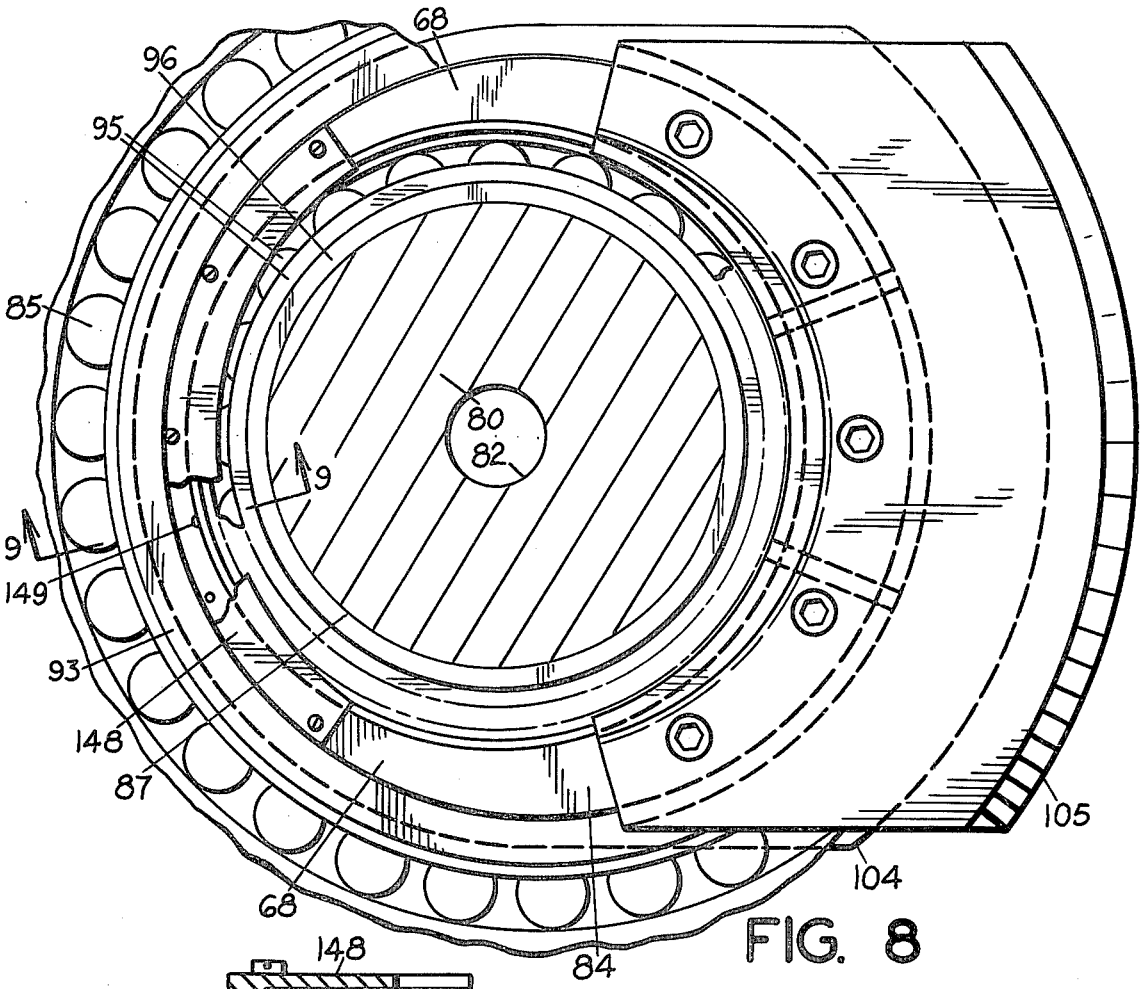
FIG. 8 is an enlarged, fragmentary sectional view taken on the line 8—8 of FIG. 2.
Figure 10:
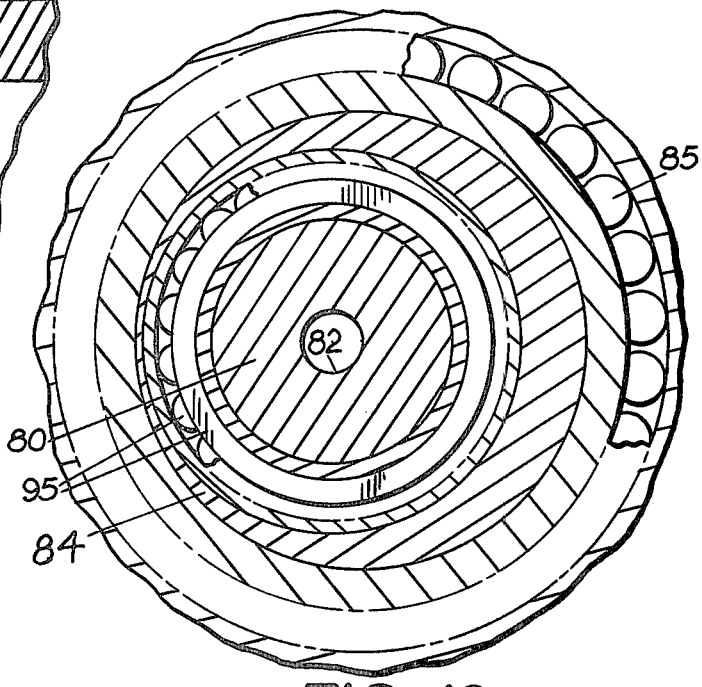
FIG. 10 is a horizontal, fragmentary sectional view taken on the line 10—10 of FIG. 2.
Figure 11:
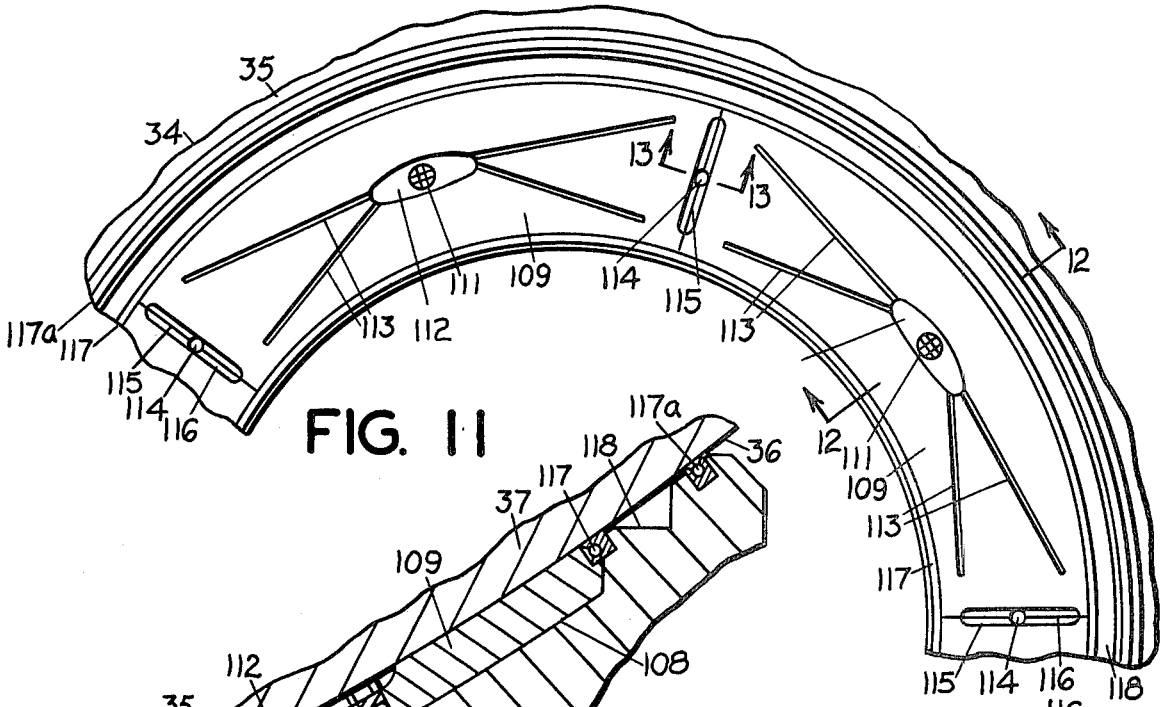
FIG. 11 is a fragmentary plan view of a bearing support area for the head.
Figure 12:
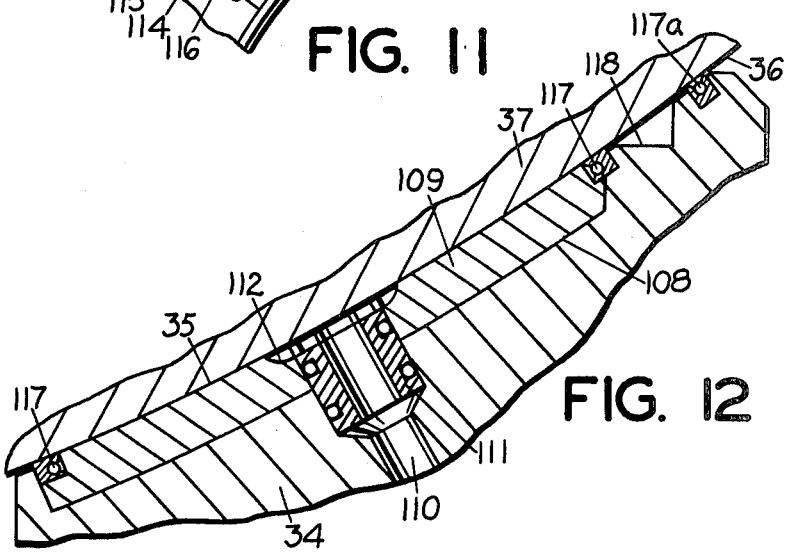
FIGS. 12 and 13 are enlarged, fragmentary sectional views taken on the lines 12—12 and 13—13 of FIG. 11, respectively.
Figure 13:
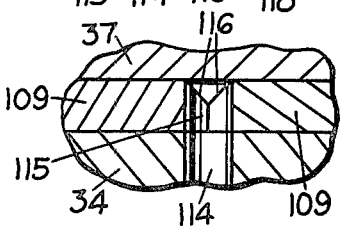

With particular reference to FIGS. 2, 8 and 10, eccentric member 68 includes an integral upstanding housing 84 with the eccentric shape as best seen in FIG. 10. This housing forms a cup shape and is journaled within a large self-aligning roller bearing assembly 85 seating at its bottom end on a shoulder 86 on frame 31 and on a shoulder 87 on the eccentric member 68. A sleeve 88 with an outer wall surface which is tapered inwardly toward the bottom is press fitted to the outer race of the bearing 85 and has wedging engagement in an upper portion 89 of the frame 31. Portion 89 has a matching taper with the outer surface of sleeve 88. The tapered sleeve 88 provides a means to press fit the outer race in place, such being necessary with the type of loading imposed, and also this sleeve is easily removable which makes replacement of the bearing 85 easy. A retaining ring 90 is releasably secured to a top flange of tapered sleeve 88 to prevent the bearing 85 from creeping upwardly. Retaining ring 90 may require shimming if the top face of sleeve 88 locates below the top face of the bearing 85. A lock nut 93 holds the eccentric member 68 from dropping out of bearing 85.

The bore of housing 84 accommodates a cylindrical roller bearing assembly 95 whose inner race has a press fit on the shaft 80. A shoulder spacer 96 abuts against head 37 and has a slight clearance with a tapered portion 97 of the shaft 80. A retaining plate 98 bolts to the bottom of shaft 80 to properly position the inner race of bearing assembly 95 in place.

As best seen in FIG. 2, the axis of shaft 80, designated by the numeral 99, is offset from the axis 100 of the outer or camming surface of the eccentric housing 84, and furthermore the inner bearing 95 and shaft 80 have tilted engagement within the inner bore of housing 94 by a selected angled bore of said housing whereby the axes 99 and 100 are offset at the bottom but meet at a vertex V at an upper portion of the crusher. Upon rotation of the eccentric member 68, gyrating actions of the head 37, as designated by reference numeral 37*a* in FIG. 1, are accomplished.

Figure 5:
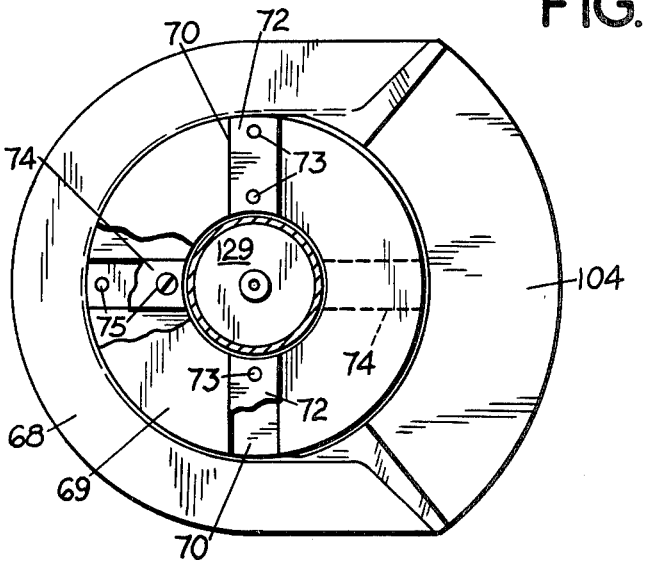
FIG. 5 is a horizontal sectional view taken on the line 5—5 of FIG. 2, a portion of this view being broken away and also certain parts being omitted for clarity.
Figure 6:
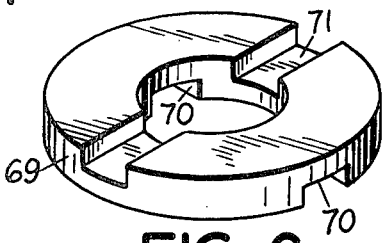
FIG. 6 is a perspective view of a coupler utilized in a drive connection of the apparatus.
Figure 7:
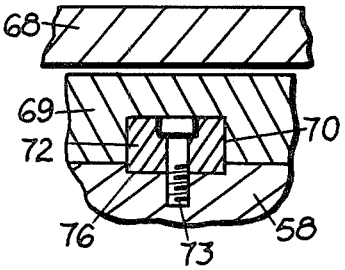
FIG. 7 is a fragmentary sectional view taken on the line 7—7 of FIG. 4.

The eccentric member 68 has an extension 104 at one side, FIGS. 2 and 5, which serves as a counterweight. In addition, a counterweight 105, FIGS. 2 and 8, is releasably secured to the top edge of the housing 84 in an area approximately above the counterweight 104. Counterweight 105 also serves as a retainer for the outer race of bearing 95. These counterweights serve to balance the centrifugal force of the gyrating cone assembly so the entire crusher sits quietly on its foundation without imposing destructive shaking motions to said foundation.

As stated hereinbefore, the bearing surfaces for the head 37 in its gyratory crushing movements comprises the cooperating surface 35 on the head support 34 and surface 36 on the head 37. Such surfaces take massive thrust forces that can crush through hydrodynamic oil films and thus are subject to damage. In order to provide maximum bearing life, however, and with reference to FIGS. 2 and 11–13, surface 35 has an annular recess 108 which receives a plurality of arcuate segments 109 of bronze bearing material or a non-metallic low coefficient of friction material such as Teflon, Delrin, Nylatron, or other suitable material. Oil under pressure is admitted to the bearing surface between head 37 and inserts 109 through passageways 110 in the frame 34. A passageway leads to each segment and opens into its bearing surface by means of a combination duct and locating pin 111 that is sealed against oil leakage at its diameter by O-rings. An enlarged recess 112 is formed in segments 109 and has radiating grooves 113 for efficient distribution of the lubricating oil to the full surface of the segments. The discharge of oil from the segments 109 is through outlet passageways 114 in the head support 34 and in the segments 109, the passageways 114 communicating with end spaces 115 between the segments. The ends of segments 109 throughout a greater portion of their length have an inward taper 116 for efficient pickup of oil to be discharged from the lubricated bearing surface.

The longitudinal edges of the segments 109 have oil seals 117 of a suitable type which will withstand high pressure and retain the lubricating oil between the two seals. The outer and inner edges of segments 109 closely abut each other to reduce oil escaping under seals 117. A third seal 117*a* is disposed outwardly from the outermost seal and is arranged to prevent inlet of dust and to wipe any escaped oil into an annular groove 118 which is provided in the frame 34 and which communicates with the drain 114. Drain 114 empties into the space above the bearings 85 and 95, FIG. 2.

The inlet of oil through passageways 110 is introduced at high pressure and more particularly at a pressure which is greater per square inch than any possible working pressure on the head 37. Thus, a hydrostatic support is provided between the head 37 and the head support 34 to maintain a layer of lubricating oil between the surfaces and substantially eliminate any metal to metal contact under the most severe conditions, thereby keeping friction to the lowest possible value and minimizing wear. When attempting to re-start a crusher that has stalled due to overload, a crusher without this hydrostatic feature will have this bearing surface in tight metal to metal contact, and starting would have high friction and bearing stresses. With this hydrostatic system, oil pressure will lift the cone head like a hydraulic jack. Metal bearing surfaces are separated before the crusher is started by suitable control means, and starting is easier and free of bearing damage. It is preferred that each segment have its own or individual pumping pressure to provide uniform and constant pressure support around the head, thus eliminating migration of oil pressure to lower pressure working areas of the head. The oscillating surfaces between the two members spreads the lubricating oil in an efficient manner and in addition the head 34 tends to rotate slowly in a direction opposite to the rotation of the eccentric member 68. The resulting motion is a wave pattern on the bearing to provide a well lubricated, long wearing support of the head on the base frame.

Figure 18:
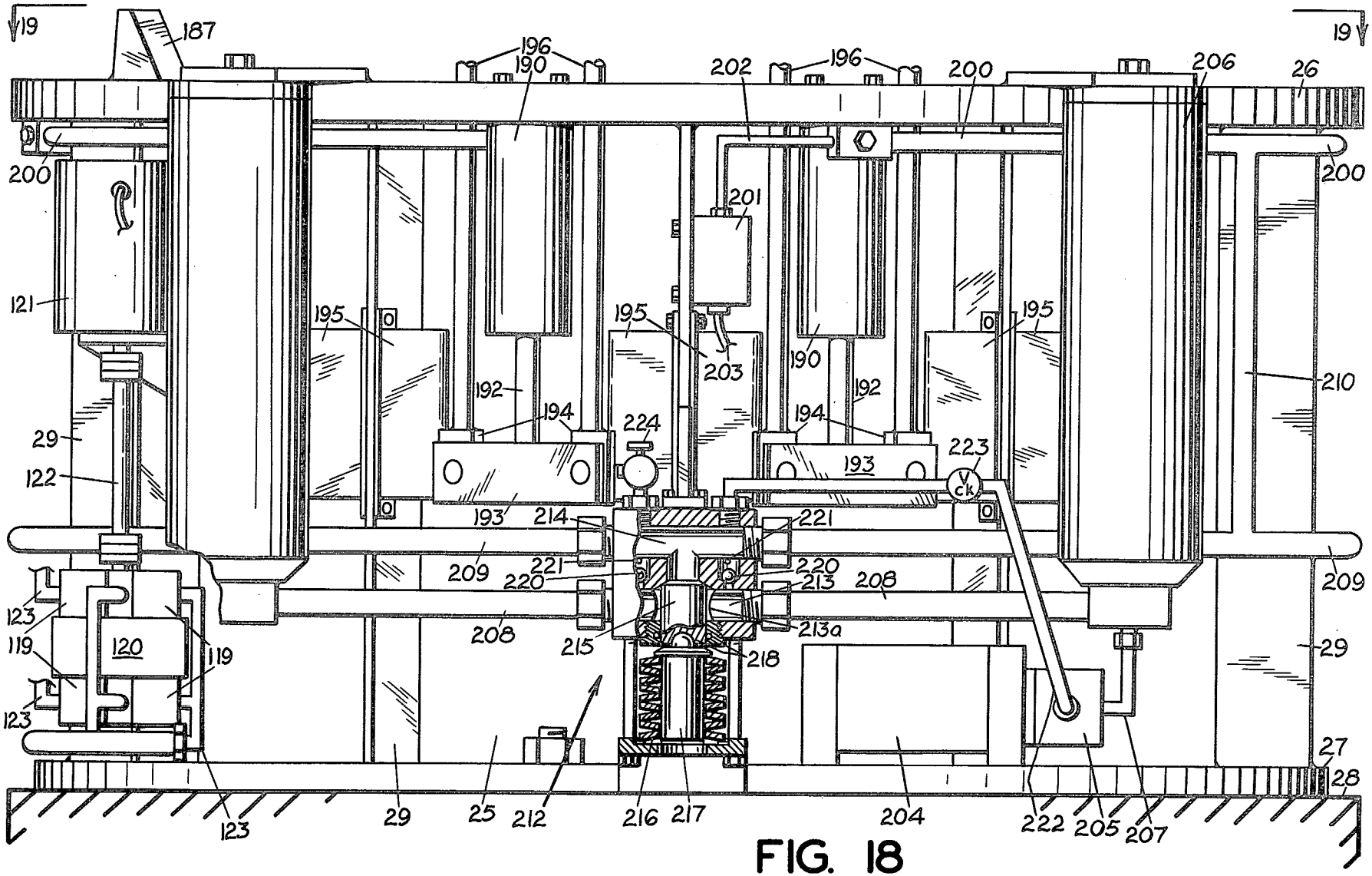
FIG. 18 is a fragmentary elevational view showing a relief system operable upon the entry of non-crushable objects into the crusher.
Figure 19:
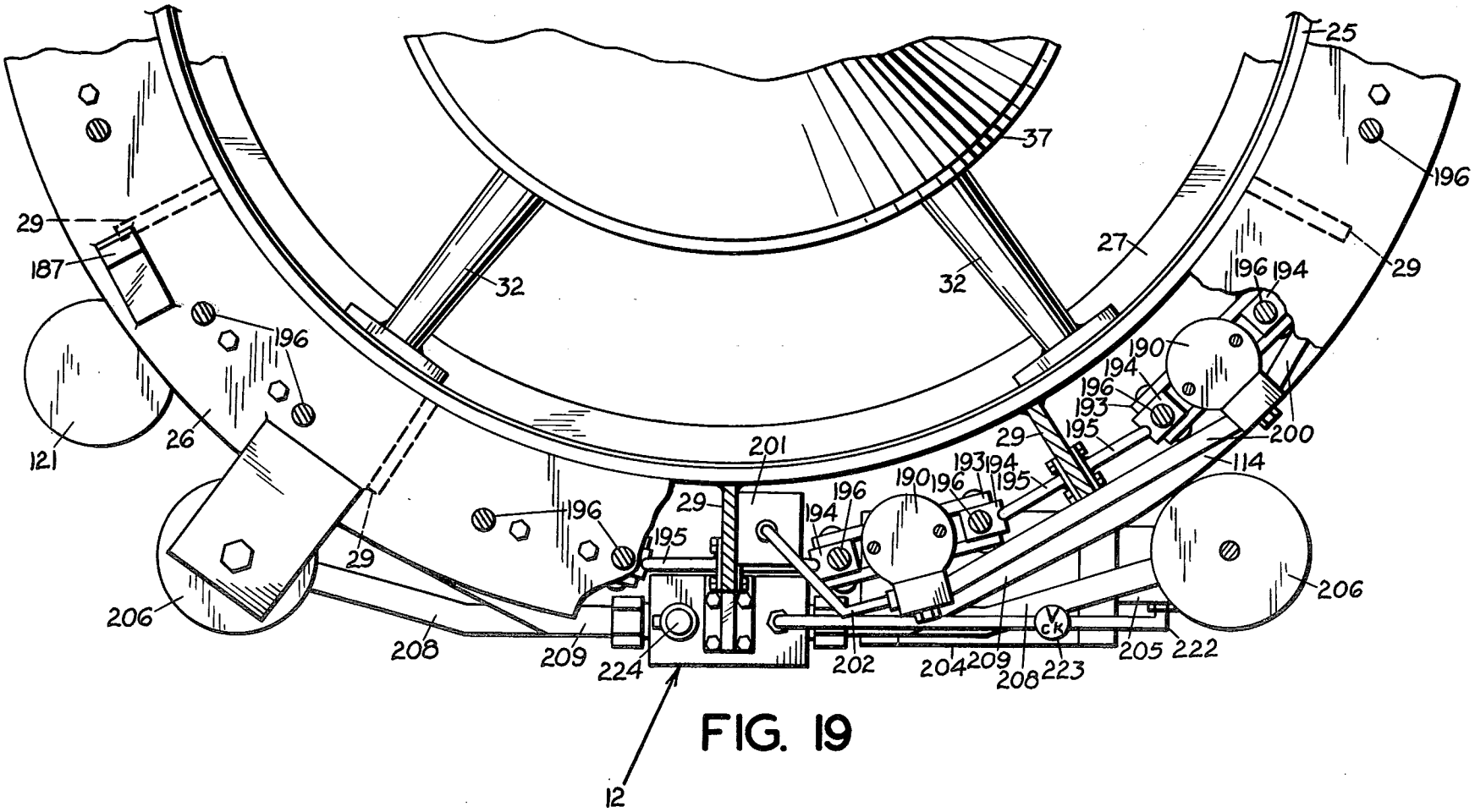
FIG. 19 is a fragmentary plan view taken on the line 19—19 of FIG. 18.
Figure 26:
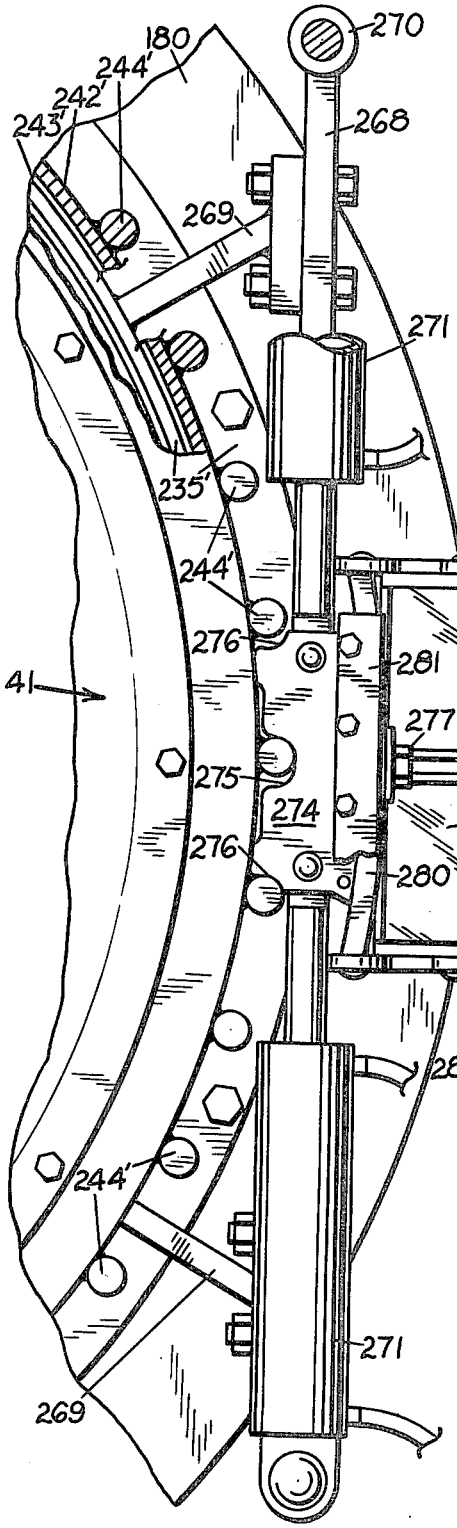
FIG. 26 is a fragmentary plan view taken on the line 26—26 of FIG. 23.
Figure 20:
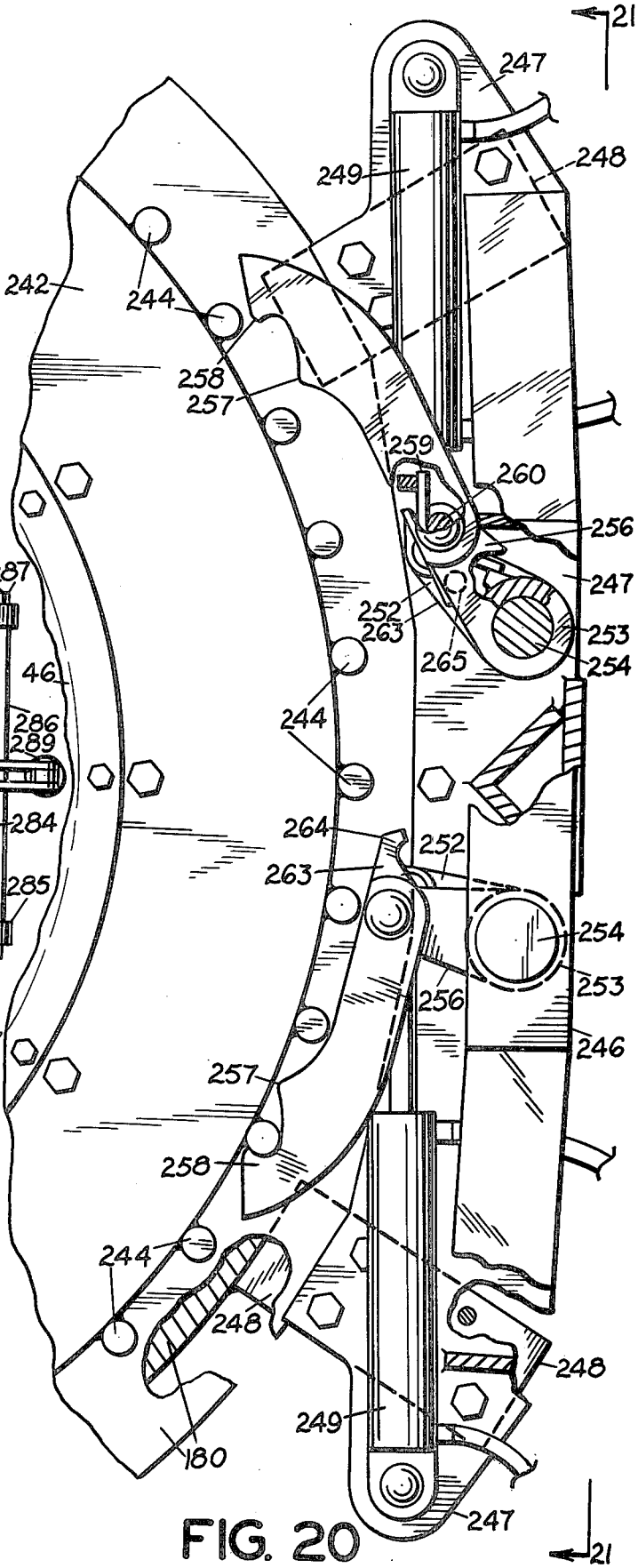
FIG. 20 is a fragmentary plan view taken on the line 20—20 of FIG. 14.
Figures 21, 22:
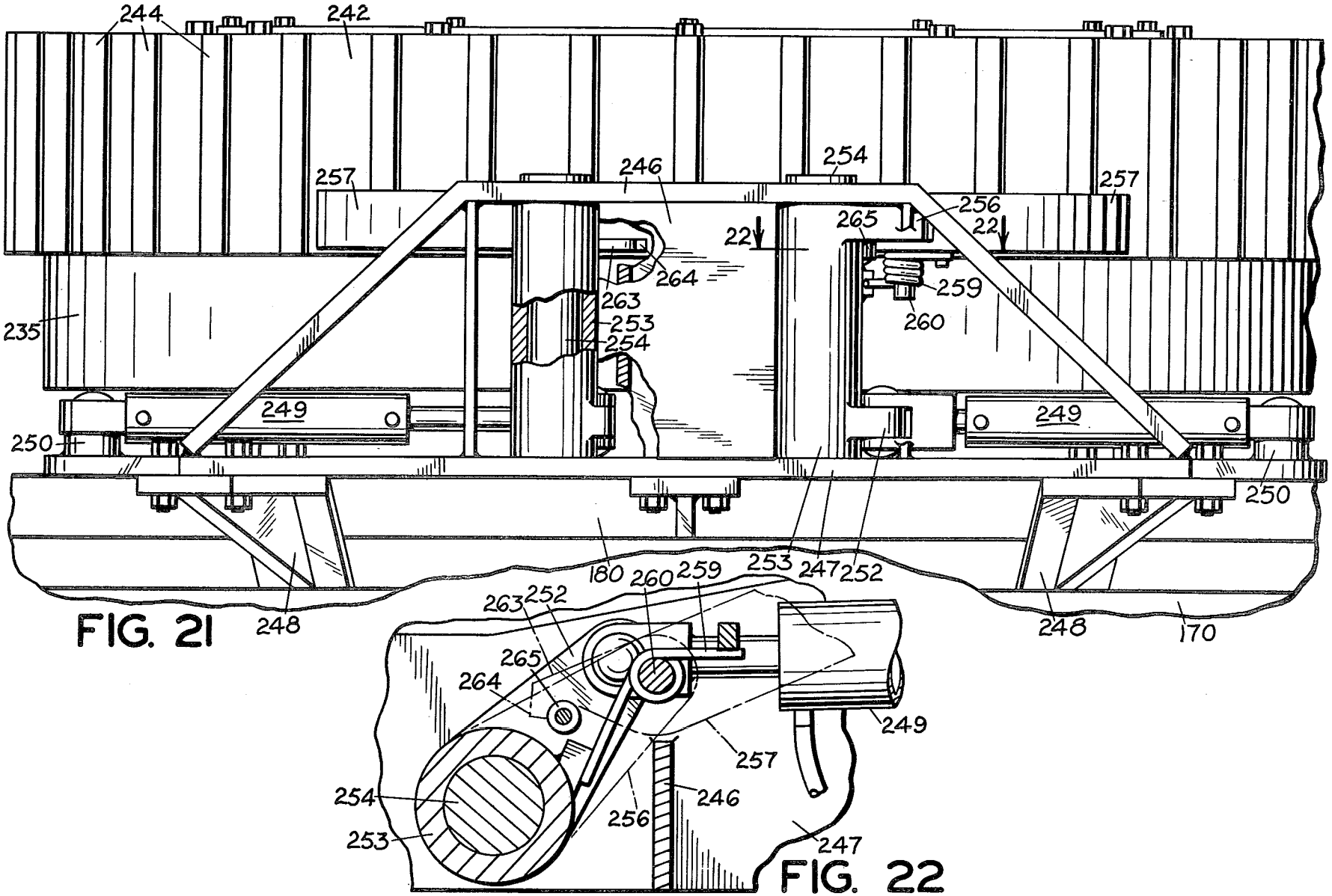
FIG. 21 is a fragmentary elevational view taken on the line 21—21 of FIG. 20.
FIG. 22 is an enlarged, fragmentary sectional view taken on the line 22—22 of FIG. 21.

With reference to FIGS. 18 and 19, a pump assembly is provided for the plurality of segments 109 and comprises individual pumps 119 secured on the crusher frame and disposed around a common gear case 120. Driving operation of the gear case is by motor 121 and connecting shaft 122. Individual pumps 119 are connected to respective segments 109 for reasons pointed out hereinbefore by individual conduits and passageways 123 and have intake from the oil reservoir 30 by suitable conduits. One or more pumps 119 can be included in the pumping assembly for lubricating other bearings in the assembly. An alternative to multiple pumps is one pump followed by a series of flow dividers that are capable of maintaining even flow in two directions despite pressure differentials.

It is to be understood that although the use of segmental inserts 109 are disclosed in the preferred embodiment, such inserts may be omitted and the hydrostatic pressure provided directly between the metal surfaces of the head and frame.

The combined weights of eccentric member 68, the inner bearing 95, the rollers, cage, and inner race of bearing 85, and other associated members attached to 68, are considerable and would impose a significant thrust load on the bearing 85 if not neutralized by some means. In this regard, and with reference particularly to FIG. 4, a fluid pressure passageway 125 leads upwardly through the shaft 59 and has pressured supply through a conduit 126 from suitable pump means such as a pump 119. Passageway 125 communicates with the interior of a cylinder 127 extending through a central opening 128 in the coupler 69 and having a piston 129 therein. The upper end of this piston has an annular projection 130 which abuts against the lower surface of eccentric member 68. Piston 129 has a preset relief valve 131 therein, and the outlet from this valve communicates with a port 132, also seen in FIG. 2, which leads through eccentric member 68 whereby oil passing through such port can flow across the upper surface of the eccentric member 68 and lubricate bearings 95. Piston 130 under the action of fluid pressure will bear the weight of the eccentric member 68 and other parts, the relief valve 131 opening at pressures as near equal as possible to the desired supporting pressure before admitting lubricating oil to the bearings 95 and other lubricated areas, to be described.

In addition, a hollow piston 135 operates over a hub 136 formed in a bottom plate 137 releasably attached to the frame 31. The piston 35 is urged upwardly by a spring 138 into abutment with a hardened face bearing 139 having an O-ring seal therein. The area of hub 136 is greater than the face contact of piston 35 on the bearing 139 and thus oil pressure in passageway 125 which extends through all these members will hold the piston against the bearing and override the same oil pressure trying to separate them. The result is that piston 135 produces an upward lifting force on the shaft 59 sufficient to prevent excessive leakage from oil pressure in conduit 125. Suitable means, not shown, are associated with piston 135 to prevent it from spinning on hub 136.

As stated, lubricating oil moving upwardly through port 132 will lubricate the inner bearing 95. The forced movement of such oil upwardly will flow or be thrown over into the area of the outer bearing 85, FIG. 2, and also lubricate it. In addition, it is apparent that oil draining from the bearing surfaces 35 and 36 between the head and the frame will also provide some lubrication. Also, several passageways 142 lead downwardly from the area above the bearing 85 and empty into the interior of frame 31, and as shown one of such passageways empties into housing 52*a* above shaft housing 52. Oil draining through this latter passageway 142 is directed through a port 143 in the housing 52 by a baffle 144 for lubricating the bearings 54. Oil also drains down through bearing 85 into the bottom of cup-shaped frame 31 and an oil level 145 is maintained for lubricating the gears. Housing 52*a* has communication with the interior of frame 31 to serve as an additional reservoir, as well as to provide a cooling or heating area for the oil.

Figure 9:
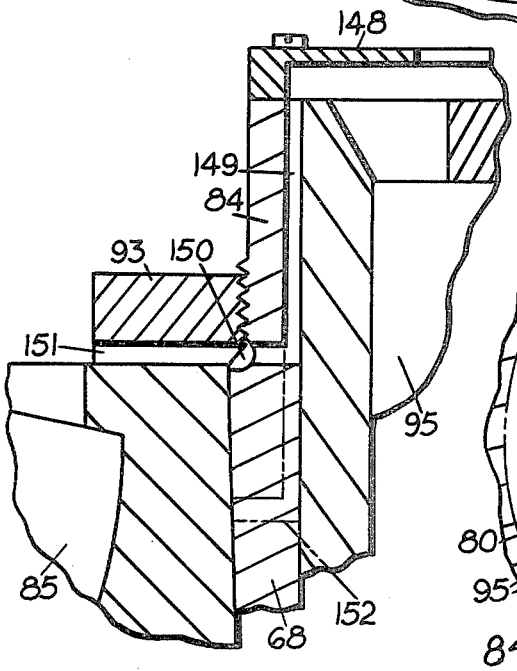
FIG. 9 is an enlarged, fragmentary sectional view taken on the line 9—9 of FIG. 8.

Because there is a creep fit between housing 84 and the inner race of bearing 85, it is desired that the engaging surfaces between such inner race and the housing 84 be lubricated. For this purpose and with reference to FIGS. 2, 8 and 9, a shield 148 is releasably secured to the upper edge of housing 84 and extends part way therearound. This shield is spaced a short distance above the top of the housing 84 and is arranged to catch oil thereunder and direct it down through several passageways 149 communicating with an arcuate groove 150 in the outer surface of housing 84 and in the lock nut 93. By means of this groove, oil is distributed around for additional lubrication to bearing 85 so centrifugal force does not throw all the emerging oil beyond bearing 85. Lock nut 93 has several passageways 151 leading outwardly from the groove 150 for directing said oil to the bearing 85. Also, an auxiliary passageway 152 leads downwardly from passageway 149 and provides oil seepage between the inner race of bearing 85 and the outer surface of housing 84.

With reference to FIG. 2, a frusto-conical seal 156 is secured between a ring 157 releasably secured in a peripheral notch 158 in the bottom edge of a depending flange 159 of the head 37. The other end of the seal is connected to a ring 160 supported on a peripheral shoulder 161 in the head support 34. Ring 160 is free to rotate relative to the support 34 and has bearing support in the groove 161 by bearing layers 162 of suitable bearing material such as a non-metallic low coefficient of friction material. Seal 156 is formed of flexible and stretchable material which is airtight and oil and ozone resistant. One acceptable material for this purpose is polyurethane. Importantly, this seal in its frusto-conical shape is directed substantially toward the vertex V whereby such seal will operate efficiently through all normal operating conditions of the head 37. That is, this seal, due to its angular disposition will efficiently follow the gyratory movements of the head with the least amount of stretching and at the same time can rotate with the head by movement of the ring 160 on the shoulder 161 and bearing 162. This seal will protect the internal workings of the crusher from the entrance dust, although in the remote circumstances that such seal should fail, the outer seal 117*a* of bearing surfaces 35 and 36, best seen in FIG. 12, will keep dust from entering the bearing surfaces and interior of the machine. The upper end of ring 160 is tapered downwardly at 163 toward the center to drain oil which may have escaped into such area back into the drain 114. An inclined port 164 leads from such tapered surface 163 to the drain 114.

Figure 3:
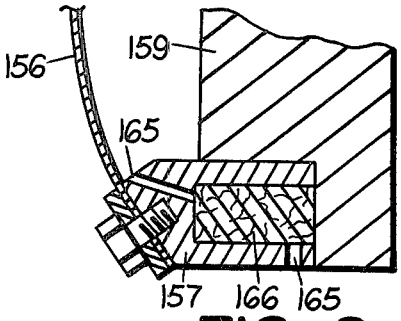
FIG. 3 is an enlarged detailed sectional view of an exterior seal structure.

With reference to FIG. 3, the ring 157 has a passageway 165 therethrough for draining oil through the seal which may have escaped into the lower area of the seal, such oil merely dripping out to the exterior of the apparatus. A filter 166 is mounted in the ring 157 across the passageway 165 to prevent the entrance of dust upwardly through the passageway.

A bowl support 170, FIGS. 1 and 14 (also seen in a modification view of FIG. 23) has an upper peaked portion 171 and a lower notched portion 172 arranged to seat on the annular reinforcing ring 26 and to extend down in a pressed fit into the top portion of body frame portion 25. Bearing liners 173 of suitable material such as Micarta are bonded to the ring 26 and machined portion of frame 25. Bowl support 170 can slip relative to the base if a sufficient and generally abnormal torque is present and such comprises an important advantage of the instant apparatus because it relieves undesirable torque in the frame.

Figure 16:
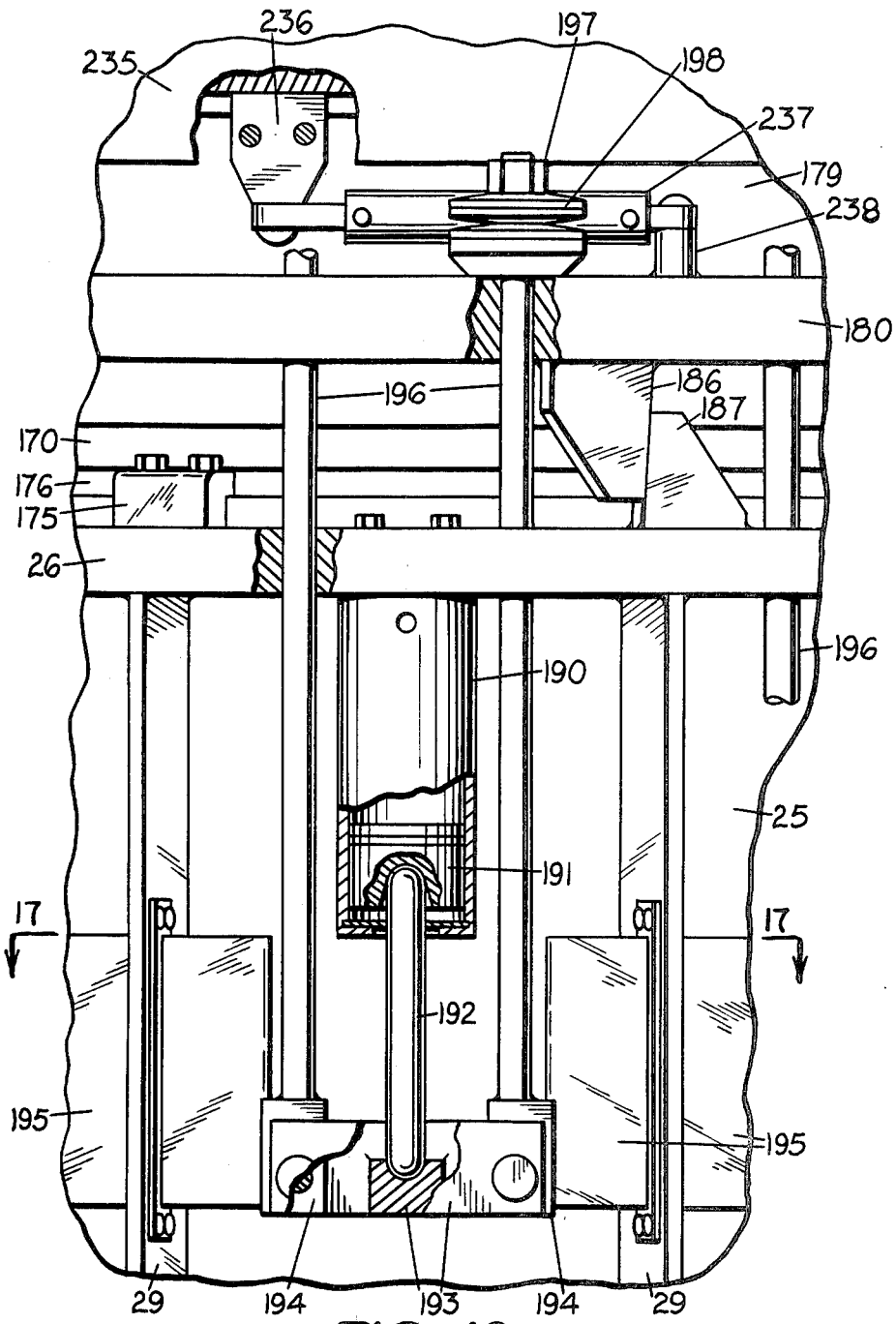
FIG. 16 is a fragmentary elevational view taken on the line 16—16 of FIG. 1.
Figure 17:
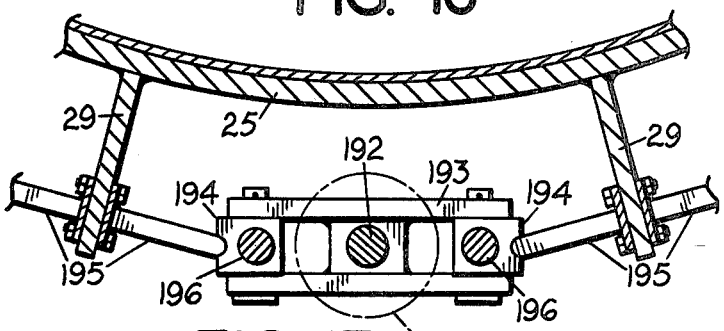
FIG. 17 is a fragmentary sectional view taken on the line 17—17 of FIG. 16.

It is desired that the bowl support 170, although being able to slip relative to the frame, be held against vertical movement off the frame, and for this purpose several clamps 175, FIG. 16 (and also FIG. 23) are bolted to the ring 26 and have finger projection into a peripheral groove 176 in the support 170.

Seated on the bowl support 170 is an annular frame or large nut 179 having an outwardly projecting flange 180 and also having an inverted V-shaped groove 181 in its bottom surface for seating engagement on the support 170. Nut 179 has internal threads 182 having meshing engagement with external threads 183 on the bowl 41.

During hard crushing, there is a tendency for the bowls of cone crushers to lift slightly or float on the frame support. This action creates enormous torques that want to drive the bowl circularly relative to the supports. In order to prevent such rotation, several depending stops 186 on the nut 179, FIGS. 1 and 16, abut against upstanding companion stops 187 on the ring 26. Rotation is thus prevented between the nut 179 and the base frame in the one direction, but as stated, the bowl support 170 can slip if forces are great enough. The engaging faces of the stops 186, 187 are angled slightly to allow their top edges to miss each other when closing back together from a separation. These stops may be made to face in opposite directions than that shown for reverse rotation of the input shaft, or if desired stops that work both ways can be used.

The floating movement of the nut 179 on the bowl support 170 is controlled by a fluid operated hold-down mechanism comprising a plurality of fluid operated cylinders 190, FIGS. 16–19, spaced around the exterior of the crusher frame and associated with a tramp iron relief system. The upper end of each cylinder 190 is bolted to the ring 26, such cylinders having pistons 191 engageable with thrust rods 192 extending in sealed engagement through the lower end of the cylinders into abutment at their lower ends against beams 193. The ends of the rods 192 are rounded and engage rounded portions of the pistons 191 and beams 193 for pivotal adjustment. Each beam 193 pivotally supports a pair of eye nuts 194 at opposite ends thereof and these eye nuts have vertical grooved guided engagement with vertical guides 195 secured to the webs 29. A pair of vertical rods 196 have threaded engagement at their lower ends with respective eye nuts 194, and these rods pass freely through ring 26 and the flange 180 of nut 179. The upper end of rods 196 receive hold-down nuts 197 and spring washers 198 between the nuts and the flange 180. Thrust rods 192 are held tightly in place between their pistons 191 and beams 193 by the spring washers 198 and by the tramp iron relief system now to be described.

Manifold sections 200 are connected to upper portions of two or more of adjacent ones of relief cylinders 190 to provide communication of these sets of cylinders with each other. One of these manifolds communicates with a pressure switch 201 by a conduit 202. Switch 201 has electrical connection by wires 203 with an electric motor 204. Switch 201 controls operation of motor 204 and will start the motor upon a selected lowering of pressure in manifold 200, as will be more apparent hereinafter. Motor 204 drives a hydraulic pump 205 connected on its input side to a pair of accumulators 206 by a conduit 207. Accumulators 206 are in communication with each other by a manifold 208. A third manifold 209 extends around the machine adjacent to manifold 208 and has communication with all the manifolds 200 by vertical connecting conduits 210.

A valve assembly 212 is connected to manifolds 208 and 209 and has a valve chamber 213 associated with manifold 208 and a valve chamber 214 associated with manifold 209. A spring loaded plunger valve 215 operates between valve chambers 213 and 214 and is arranged to control fluid flow from chamber 214 to chamber 213 in one direction, the latter chamber being enlarged at **213*a* around the plunger to allow free passage of fluid between the two accumulators 206. Valve 215 is selectively pre-loaded by a spring assembly 216, preferably comprising a stack of spring washers, thrusting against an auxiliary plunger 217 having a ball and socket engagement 218 with plunger 215. Ball and socket connection 218 prevents any binding of plunger 215**.

A pair of ball check valves 220 as well as valve 215 stops fluid flow under normal conditions from chamber 214 to chamber 213, the check valves 220 being held in operative position by retaining pins 221. A conduit 222 leads from the outlet of pump 205 to chamber 214 of valve assembly 212, this conduit having a check valve 223 therein to prevent oil from bleeding back into the pump. Chamber 214 has a manually operable relief valve 224 to drain the pressure from the system.

The relief system is set up for operation as follows: The cylinders 190 and their manifolds 200 and 209, as well as chamber 214 in valve assembly 212, are pressurized at a specific pressure, for example, 2500 PSI, this pressure comprising a desired hold-down force for illustration purpose. The lower chamber 213 of valve assembly 212 as well as the accumulators and manifold 208 are pressurized at a pressure a few hundred pounds lower than the pressure in chamber 214 and its associated parts, for example, 2100 PSI. The accumulators 206 are initially charged to approximately 1800 PSI with nitrogen gas. Oil is then pumped into the accumulator system to raise the pressure to the desired 2100 PSI. This builds up an ample reservoir of oil for pump 205 to keep chamber 214 suitably charged as will be described. The pressure in the accumulators will vary according to temperature but the pressure in chamber 214 will be substantially constant. Spring 216 is preloaded to allow plunger valve 215 to open at a higher pressure than that which exists in chamber 214, for example, 2750 PSI. The pressure switch 201 is arranged to energize the pump motor 204 when the pressure drops a slight amount below the pressure in the relief cylinders, for example, 2475 PSI. In normal operation, some slight up and down movement of the bowl 41 and nut 179 will exist. This slight movement will be absorbed by the springs 198. Such spring action prevents damaging fluttering movement of the pistons 191 in their cylinders 190.

However, when a non-crushable object such as a piece of "tramp iron" enters the crusher, the bowl 41 and nut 179 raise more than normal as the cone-shaped head 37 presses against the object. The pistons 191 in the relief cylinders 190 in that particular section of the relief system rise and hydraulic fluid flows through manifolds 200 and 209 into valve chamber 214 and push the plunger 215 open. Fluid then flows into chamber 213 of valve assembly 212 to provide relief in the cylinders 190 and thus in the hold-down function. The accumulators 206 absorb fluid entering valve chamber 213 and manifold 208. As the cone gyrates away from the object, the fluid returns from chamber 213 to chamber 214 through ball check valves 220. This action repeats until the object has cleared the crusher and as is apparent the pressure in the two valve chambers 213 and 214 will be substantially the same. As soon as the pressure in manifold 200 gets below a selected value, namely 2475 PSI in this illustration, switch 201 starts motor 204 for restoring normal pressure to valve chamber 214 and of course the relief cylinders 190. In this arrangement, the pump only has to raise the pressure a small amount, for example, from the lowered pressure to the 2500 PSI normal. Such eliminates the necessity of the pump having to raise the pressure back up from zero.

It is necessary to firmly jam or lock the thread engagement between bowl 41 and the nut 179 to maintain desired crusher adjustment and to resist destructive movement during crushing operations and when violent inertial action occurs from non-crushable objects passing through the crusher. For this purpose, an annular jam nut 230, FIG. 14, seats on the top edge of nut 179 and threadedly engages the threads 183 of the bowl. A non-metallic low coefficient of friction bearing washer 231, also seen in FIG. 15, is disposed between the jam nut 230 and the nut 179. With particular reference to FIG. 15, thread liners 232 which may also be constructed of a non-metallic low coefficient of friction bearing material are secured between the threads 182 and 183. Preferably, these liners are secured to the threads 182 on the nut 179. The threads and liners are dimensioned and arranged such that those on the bottom surfaces of threads 182 fill the space between the threads 182 and 183. These threads take the upward thrust of bowl 41 during crushing operations. The liners on the upwardly facing surface of threads 182 have clearance with threads 183 and merely serve as bearing surfaces when the crusher is being adjusted. A liner 233 may also be provided between an upwardly facing surface of one or more threads of jam nut 230 and threads 183. The liners 232 and 233 reduce the unlocking force required to release nuts 179 and 230 and provide assist in the adjustment of the crusher while crushing by eliminating metal to metal contact and a much reduced coefficient of friction. These liners also prevent seizing of the threads by galling or corrosion.

An upright sleeve 235 is secured, as by welding, to the outer peripheral surface of jam nut 230 with portions thereof projecting above and below the jam nut. Attached to the inner surface of the lower projecting portion of sleeve 235 are one or more depending arms 236, FIGS. 1 and 16, pivotally connected to one end of a fluid operated cylinder 237. The other end of cylinder 237 is pivotally anchored to a post 238 integrated with the flange 180 of nut 179. The working movement of the fluid operated cylinders 237 is such as to fully release the jam nut 230 in one direction of movement and to fully lock the jam nut in the other direction of movement. Two of the cylinder assemblies 237 are disposed in diametrical relation on the machine and are used to balance the torque drive. The fluid operated cylinders 237 are selectively disposed and the thread arrangement is such that the cylinders utilize a pushing movement of their pistons to unlock the jam nut 230, thus utilizing the greater power of the pistons as compared to their pulling power to release the break-out torque and friction required which is greater than the locking friction. Because it is mandatory to unlock the system before adjustment can be made, the cylinders must have enough thrust to accomplish this unlocking and rotating function. Means are provided for the power rotation of bowl 41 for functions of its installation, removal, or adjustment, and for this purpose, an annular angular housing 242, FIGS. 1 and 14, is bolted to the top edge of the bowl 41 and made dust tight therewith by an O-ring seal 241. Housing 242 extends downwardly in partial overlapping relation with the sleeve 235, and a combination bearing and dust seal 243 is disposed between the overlapping portions to allow a sealed bearing rotation between these parts. The exterior of the housing has a plurality of evenly spaced vertical projections or lugs 244.

One or more truss-like members 246, FIGS. 14 and 20–22, have an integral bottom plate 247 bolted to brackets 248 welded to the nut 179. Two fluid operated cylinders 249 are pivotally anchored to end posts 250 and are pivotally connected at their other ends to respective lever arms 252 integral with upright sleeves 253 pivotal on shafts 254 supported in the truss member 246. The upper ends of sleeves 253 have a lever arm 256 which is pivotally connected to one end of a pawl 257 having a hook end 258 arranged for pulling engagement with projections 244. Pawls 257 are urged rotatably toward the housing 242 into engagement with projections 244 by means of torsion springs 259 contained on a depending extension 260 of the pivot support for the pawl.

The ends of the pawls 257 opposite from the hook end have an integral extension 263 projecting under the lever arm 256 and terminating in a second hook 264. These hooks are associated with stops 265 on the undersurface of arms 256. The arrangement is such that upon retracted movement of the fluid operated cylinders 249 to a point where the arms 256 and pawls form approximately a straight line, the hooks 264 engage stops 265 to stop the action of the springs 259 on their pawls 257, whereby continued retracting movement of the cylinders causes the pawls to swing clear of lugs 244.

In the operation of the power rotating means for the bowl 41, one cylinder 249 will drive while the other one retracts whereby upon repeated operations, the bowl can be ratcheted in the direction desired. The controls for operating the cylinders 249 are not shown but their operation is readily accomplished by conventional valving either under manual control or by automatic control. Rotation of the bowl for adjustment vertically or for releasing it after crusher use will take place of course only after release of the jam nut 230 which will again be tightened when rotation of the bowl has been completed.

A modified form of power rotative adjustment of the bowl is shown in FIGS. 23–26. This embodiment also shows a slightly different bowl and jam nut construction wherein the jam nut 230' has a sleeve 235' bolted to the upper surface thereof which projects upwardly in close association to the threads 183 of the bowl. An angular housing 242' on the bowl overlaps a portion of the sleeve 235', a combination seal and bearing 243' being provided between the overlapping portions. Evenly spaced projections or lugs 244' are provided on the bowl.

A vertical plate 268 is bolted to brackets 269 welded to the nut 179, and such plate supports integral posts 270 at opposite ends thereof. One of the ends of a pair of fluid operated cylinders 271 is connected to the respective posts and the ends of the piston rods are pivotally connected to notched ends 272 of a single pawl or slide block 274. Pawl 274 has a centrally located inner edge notch 275 and a pair of shallow end notches 276. As will be more apparent hereinafter, the pawl 274 is arranged to drive the bowl in either direction, and as best seen in FIG. 24 the notches 275 and 276 are arranged such that the pawl will engage two of the projections 244' at a time for driving in either direction. A cap screw 277 passes through an elongated guide slot 278 in a curved guide plate 280 and is threadedly engaged with the pawl 274. Cap screw 277 is adjusted with sufficient clearance so as to have slidable guided movement of pawl 274 against plate 280. A cap plate 281 is bolted to the top of pawl 274 and overlaps the plate 280 to shield the slide surface from dust and assist in the stabilization of pawl 274.

A pair of spaced standards 283 are secured integrally to the nut 179 and pivotally support at their upper ends a lever arm assembly 284 having an upright body portion 285 secured integrally to the bottom of the pawl supporting plate 280. A toggle assembly 286 is pivotally supported at the lower ends of the standards 283, and such toggle assembly is pivotally connected to the upper lever arm assembly 284 by two toggle links 287. An upright fluid operated cylinder 289 is pivotally supported at its lower end on a bifurcated arm 288 integral with toggle assembly 286. The upper end of cylinder 289 is pivotally connected to lever arm assembly 284. As seen in full and broken lines in FIG. 23 such cylinder is arranged to pivot the upper lever arm assembly and the toggle assembly to extend or close the pawl 274. The toggle links have stops 292 which limit overcenter movement in an outward direction.

The two fluid operated cylinders 271 operate in unison, namely, they assist each other in both directions of operation. When it is desired to turn the bowl of the crusher, fluid operated cylinder 289 is first extended to place the pawl 274 in engagement with projections 244'. Jam nut 230' is then unlocked, the cylinders 271 are driven in the desired direction and upon completion of their travel, the cylinder 289 is retracted to release the pawl 274. The cylinders 271 are then operated in the opposite direction to move to a new drive position at which time the cylinder 289 again moves the pawl inwardly. This procedure is repeated to provide the desired rotation. When the desired rotation is made and a crushing operation is to take place, the jam nut 230' is tightened by means of its fluid operated cylinder. The pawl construction of the embodiment of FIG. 23 has the advantage that the bowl cannot overrun when adjusting since the pawl will catch and hold any such over-running rotation. Also, since the two fluid operated cylinders work together, half as large a cylinder area is required as compared to where one fluid operated cylinder does the work. Either adjusting system of FIG. 20 or FIG. 26 will work with either housing 242 or 242'.

Figure 27:
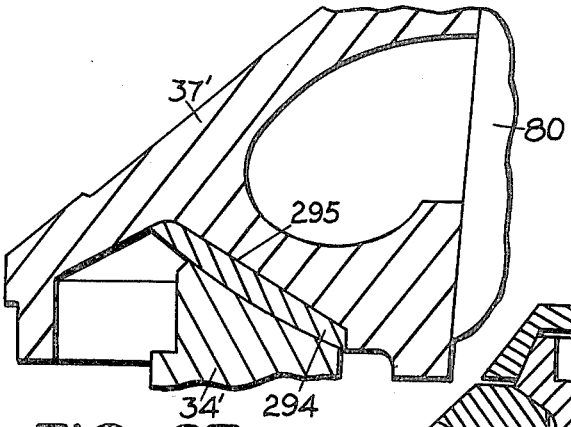
FIG. 27 is a fragmentary sectional view showing a modified bearing support for the crushing head.

Referring to FIG. 27, a modified bearing support between the cone-shaped head 37' and the head support 34' is illustrated. In this embodiment, a bearing insert 294 is set in a recess 295 in the head 37' and has a spherical bottom surface engaging the dished supporting surface of head support 34'. Insert 294 may be replaced as necessary.

Figure 28:
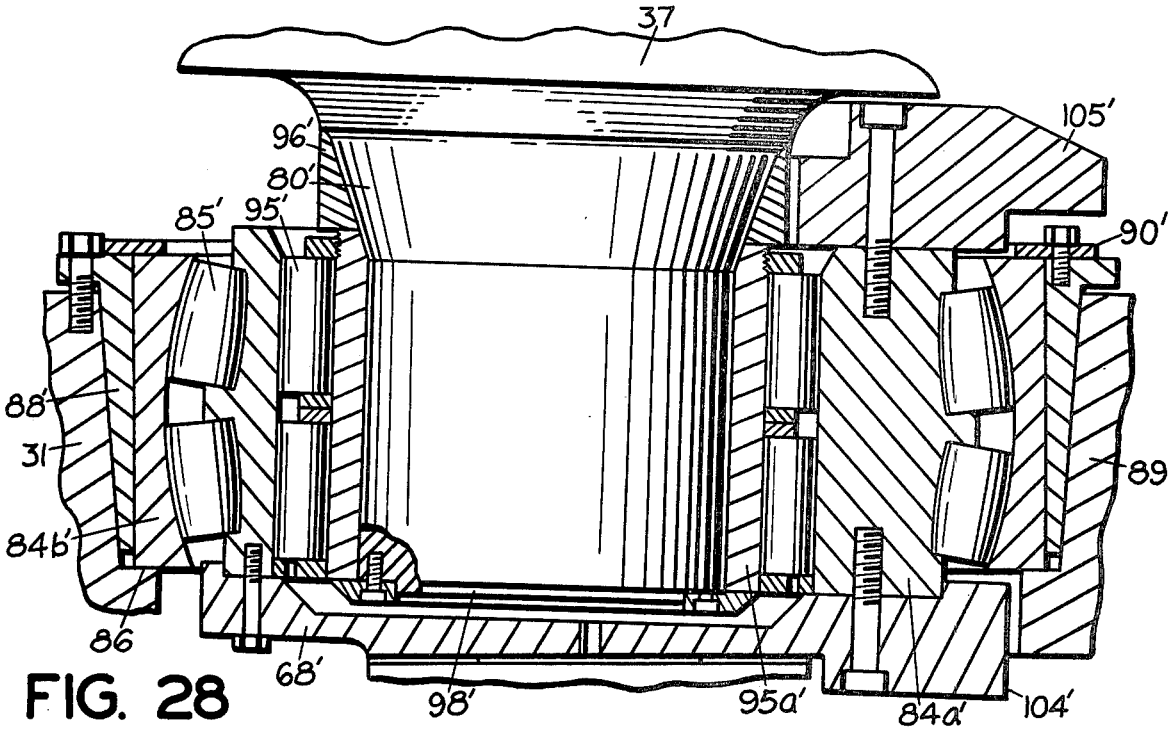
FIG. 28 is a view similar to FIG. 2 but showing modified eccentric drive structure.

Referring to FIG. 28, a modified form of eccentric drive is shown for the main upper shaft 80'. In this modification, the eccentric member is a triple race bearing having an eccentric middle race **84*a'* and is similarly driven from below as in the first embodiment. It also employs a counterweight portion 104'. The middle race 84*a'* has a driving flange 68' bolted to its lower face and carries a counterweight 105' at its upper face. Middle race 84*a'* is journaled between an inner set of rollers and an outer set of rollers. Its outer surface thus comprises the inner race for a large self-aligning roller bearing 85' engageable with an outer race 84*b'*. Outer race 84*b'* seats on the shoulder 86 of the frame 31. The middle race 84*a'* forms the outer race of roller bearings 95' whose inner race 95*a'* has a press fit on the shaft 80'. A shoulder spacer 96' and a retaining plate 98' hold the inner race 95' in place. As in the first embodiment, a tapered sleeve 88' is press fitted within the frame 31, and a retaining plate 90' is bolted to the top of this sleeve to hold the outer race 84*b'*** in place.

The eccentric and drive arrangement of the embodiment of FIG. 28 is similar to that illustrated in FIG. 2 with the exception that the eccentric midrace **84*a'*** is utilized also as bearing races on opposite surfaces thereof, thus minimizing the number of parts necessary in this radial bearing area and providing a more compact design.

According to the present invention, a gyrating or cone-type crusher is provided which is extremely efficient in operation and which is relatively simplified and inexpensive to manufacture. The parts operate efficiently with a minimum of wear and are arranged for easy replacement. In addition, the inner parts are effectively sealed against the inlet of dust or foreign particles to further prolong the working life of the parts. Further yet, means are provided to minimize damaging strains in the various parts and also, power adjustment of the bowl facilitates operation of the crusher by a single person.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A rock crusher comprising (a) a base frame having upper and lower portions,
(b) a crusher head having a depending shaft portion,
(c) cooperating seat means on said frame and head supporting said head for lateral movement relative to said frame,
(d) a bowl on said frame associated with said head to form a crushing area,
(e) rotatable input powered drive means on said frame,
(f) cup-shaped eccentric means driven rotatably by said drive means,
(g) said cup-shaped eccentric means including a bottom plate-like body portion and an upright housing on said body portion,
(h) an inner circular opening in said housing for receiving the depending portion of said shaft,
(i) the axis of said circular opening being concentric with the axis of said shaft and obliquely intersecting the axis of rotation of said body portion,
(j) an outer upright cam surface on the exterior of said housing which is concentric with the axis of said plate-like body portion,
(k) and bearing means between said cam surface and said frame, whereby said head is moved in gyratory motion upon rotation of said body portion.

2. The rock crusher of claim 1 including second bearing means, said second bearing means being disposed between said shaft and said housing.

3. The rock crusher of claim 2 including passageway means extending through said housing and arranged to direct lubricating oil from said second bearing means to the area between said housing and said bearing means which is disposed between said cam surface and said frame.

4. The rock crusher of claim 1 wherein said bearing means between said cam surface and said frame comprises a self-aligning bearing.

5. The rock crusher of claim 1 including a sleeve removably mounted between said bearing means and said frame, said sleeve being tapered to a thinner dimension toward the bottom for wedge fitting between said bearing means and said frame.

6. The rock crusher of claim 1 wherein seat means comprises a convex-concave engagement, lubricating oil inlet means leading to the seating area between said frame and head, and pressure supply means arranged to admit lubricating oil to said seating area at a pressure at least as great as the working pressure between said head and frame to provide fluid support of said head on said frame.

7. The rock crusher of claim 1 wherein said seat means comprises a convex-concave engagement, lubricating oil inlet means leading to the seating area between said frame and head, and pressure supply means arranged to admit lubricating oil to said seating area at a pressure at least as great as the working pressure between said head and frame to provide a fluid supporting layer of oil between said head and frame.

8. The rock crusher of claim 1 wherein said seat means comprises a convex-concave engagement, lubricating oil inlet means leading to the seating area between said frame and head, and pressure supply means arranged to admit lubricating oil to said seating area at a pressure to provide fluid support of said head on said frame, one of the surfaces of said concave-convex seat having a segmented inset bearing layer, said pressure supply means including individual supply means for each segment.

9. The rock crusher of claim 1 wherein said eccentric means comprises a bearing assembly having inner and outer races and a middle race, said middle race having an eccentric shape.

10. The rock crusher of claim 1 wherein said crusher head is cone shaped and has an outer circumferential depending flange, an annular ring rotatably supported on said frame inwardly of said flange, and a flexible sheet of sealing material connected between said depending flange and said ring, said sheet of sealing material being connected to said flange and said ring in a position to angle upwardly so as to be directed approximately at a vertex formed by the intersection of the axes of said shaft and said plate-like body portion.

11. The rock crusher of claim 1 including fluid pressure lift means operative to bear some of the weight of said eccentric means and said bearing means.

12. The rock crusher of claim 1 including second bearing means disposed between said shaft and said housing, said bearing means between said cam surface and said frame and said second bearing means having support on said eccentric means, and fluid pressure lift means to bear some of the weight of said eccentric means and said bearing means.

13. A rock crusher comprising
(a) a base frame,
(b) a crusher head on said frame,
(c) cooperating convex-concave seat means on said frame and head supporting said head for lateral movement relative to said frame,
(d) eccentric means operable with said head to produce gyratory movement upon rotation of said eccentric means,
(e) rotatable input powered drive means operating said eccentric means,
(f) lubricating oil inlet means leading to the seating area between said frame and head,
(g) and pressure supply means arranged to admit lubricating oil to said seating area at a pressure at least as great as the working pressure between said head and frame to provide fluid support of said head on said frame.

14. A rock crusher comprising
(a) a base frame,
(b) an outer cone-shaped crusher head on said frame having a circumferential depending flange,
(c) a bowl on said base frame associated with said head to form a crushing area therebetween,
(d) means operable with said head to produce gyratory movement thereof having a vertex disposed at an upper portion relative to said head,
(e) an annular ring rotatably supported on said frame inwardly of said flange,
(f) and a flexible sheet of sealing material connected between said depending flange and said ring,
(g) said sheet of sealing material being connected to said flange and said ring in a position to angle upwardly so as to be directed approximately at said vertex.

15. The rock crusher of claim 14 wherein said seal includes an oil outlet at a lower portion thereof to discharge escaping oil from said head, and dust filter means in said oil outlet preventing the inlet of dust but allowing the outlet of oil.

16. A rock crusher comprising
(a) a base frame,
(b) a crusher head on said base frame,
(c) a bowl on said frame associated with said head to form a crushing area,
(d) eccentric means operable with said head to produce gyratory movement thereof upon rotation of said eccentric means,
(e) rotatable input powered drive means operating said eccentric means,
(f) a fluid operated cylinder secured to one of said frame or bowl and having a piston operating therein,
(g) a piston rod projecting from the piston in said cylinder,
(h) tension rod means pivotally connected to one of its ends to said piston rod and slidable at its other end through a portion of the other of said frame or bowl,
(i) said fluid operated cylinder being arranged to apply a selective compressive force against said piston rod and a tension force against said tension rod means,
(j) abutment means on said tension rod means disposed on the opposite side of said frame or bowl portion from said beam and limiting lifting movement of said bowl on said frame,
(k) and spring means between said abutment means and said frame or bowl portion allowing a small amount of relative movement between said bowl and frame without movement of said piston in said cylinder.

17. A rock crusher comprising
(a) a base frame,
(b) a crusher head on said frame,
(c) a bowl on said frame associated with said head to form a crushing area therebetween,
(d) means operable with said head to produce gyratory movement thereof,
(e) fluid operated cylinder means secured between said frame and bowl and arranged to allow raised movement of said bowl against the force of said cylinder means when a non-crushable object passes through the crusher,
(f) a pressure relief system,
(g) valve means connected between said cylinder means and said relief system and arranged to relieve the pressure in said cylinder means into said relief system when a non-crushable object passes through the crusher,
(h) pump means communicating with said cylinder means,
(i) and actuating means for said pump means operated by the lowered relief pressure in said cylinder means to cause said pump means to restore said cylinder means to original pressure.

18. The rock crusher of claim 17 wherein said pressure relief system comprises at least one oil accumulator pressurized at a lower pressure than the normal operating pressure of said cylinder means.

19. The rock crusher of claim 17 wherein said pressure relief system comprises at least one oil accumulator pressurized at a lower pressure than the normal operating pressure of said cylinder means, said valve means being arranged to admit fluid from said cylinder means to said accumulator upon a selected raised pressure in said cylinder means caused by a non-crushable object passing through the crusher.

20. The rock crusher of claim 17 wherein said actuating means comprises a pressure actuated switch.

21. The rocker crusher of claim 17 including a plurality of said cylinders spaced around said base frame, and manifold means connecting said cylinders to said valve means whereby said cylinders provide rotative relief around said head as the latter is driven in gyratory movement.

22. The rock crusher of claim 17 including at least one oil accumulator in said pressure relief system normally pressurized at a lower pressure than the normal operating pressure of said cylinder means, said valve means being arranged to admit fluid from said cylinder means to said accumulator upon a selected raised pressure in said cylinder means caused by a non-crushable object passing through the crusher whereby to equalize the pressure in said cylinder means with the pressure in said accumulator, said actuating means comprising a pressure operated switch causing actuation of said pump means when the pressure in said cylinder means is reduced by said pressure relief system to an amount less than the original operating pressure of said cylinder means but greater than the normal pressure of said accumulator.

23. A rock crusher comprising
(a) a stationary base frame,
(b) a crusher head on said base frame,
(c) a bowl associated with said head to form a crushing area,
(d) eccentric means operable with said head to produce gyratory movement thereof upon rotation of said eccentric means,
(e) a support ring on said frame providing a supporting seat for said bowl on said frame,
(f) and resilient hold-down means secured between said frame and bowl,
(g) said support ring being rotatable relative to said frame whereby to relieve torque stresses between said frame and head.

24. The rock crusher of claim 23 including bearing means between said support ring and said frame.

25. The rock crusher of claim 23 wherein said support ring has a bearing engagement with said frame for rotation relative to said frame, and including clamp means secured between said support ring and said frame holding said support ring down on said frame but allowing said ring to rotate.

26. The rock crusher of claim 23 wherein said bowl includes a bowl nut supporting it on said support ring and including abutting stop means on said base frame and bowl nut having abutting engagement to prevent relative rotation of said base frame and said bowl.

27. A rock crusher comprising
(a) a base frame,
(b) a crusher head on said base frame,
(c) a bowl on said frame associated with said head to form a crushing area,
(d) eccentric means operable with said head to produce gyratory movement thereof upon rotation of said eccentric means,
(e) support means on said bowl supported on said base frame,
(f) said support means having vertical threaded connection with said bowl whereby upon rotation of said bowl it is arranged to be raised or lowered,
(g) and jam nut means threadedly engaged with one of said bowl or support means and vertically abutted against the other of said bowl or support means whereby said jam nut holds said bowl and support means in non-rotative connection when its threads are forcefully jammed against the threads of said one bowl or support means.

28. The rock crusher of claim 27 including bearing liner means between the threads of said bowl and said support means to reduce the unlocking force required to rotate said bowl and to prevent seizing of the threads by galling or corrosion.

29. The rock crusher of claim 27 including fluid operated cylinder means arranged to drive said jam nut means rotatably in connecting and release positions.

30. A rock crusher comprising
(a) a base frame,
(b) a crusher head on said frame,
(c) cooperating convex-concave seat means on said frame and head supporting said head for lateral movement relative to said frame,
(d) eccentric means operable with said head to produce gyratory movement upon rotation of said eccentric means,
(e) rotatable input powered drive means operating said eccentric means,
(f) lubricating oil inlet means leading to the seating area between said frame and head,
(g) and pressure supply means arranged to admit lubricating oil to said seating area at a pressure to provide fluid support of said head on said frame,
(h) one of the surfaces of said convex-concave seat having a segmented inset bearing layer and said pressure supply means including an individual supply for each segment.

31. A rock crusher comprising
(a) a base frame,
(b) a crusher head on said frame,
(c) a bowl on said frame associated with said head to form a crushing area,
(d) eccentric means including a body member with a bottom surface and being operable with said head to produce gyratory movement upon rotation of said eccentric means,
(e) rotatable input powered drive means spaced from said eccentric means and including a substantially horizontal top surface,
(f) and independent coupling means establishing a drive connection between said eccentric means and said input drive means,
(g) said coupling means comprising a disc-like member disposed between the bottom surface of said body member and the top surface of said drive means and cooperating grooves and keys in said disc-like member and the top surface of said drive means for establishing a drive connection.

32. The rock crusher of claim 31 wherein said cooperating grooves and keys comprise grooves on opposite faces of said disc-like member and keys on said body member and rotatable drive member engageable in said grooves.

33. The rock crusher of claim 31 wherein said cooperating grooves and keys comprise grooves on opposite faces of said disc-like member and keys on said body member and rotatable drive member engageable in said grooves, said disc-like member being of less thickness than the space between the body member of said eccentric means and the top surface of said drive member to provide misaligned adjustment between these parts.

34. The rock crusher of claim 31 wherein said cooperating grooves and keys comprise grooves on opposite faces of said disc-like member and keys on said body member and rotatable drive member engageable in said grooves, said keys being removably attached to the respective members by removable fasteners and being fitted in grooves in said members to prevent lateral shearing forces from acting on said fasteners.

35. A rock crusher comprising
(a) a base frame,
(b) a crusher head on said frame,
(c) a bowl on said frame associated with said head to form a crushing area,
(d) eccentric means operable with said head to produce gyratory movement upon rotation of said eccentric means,
(e) said eccentric means comprising a bearing assembly having inner and outer races and a middle race, said middle race having an eccentric shape,
(f) rotatable input powered drive means spaced from said eccentric means,
(g) and independent coupling means establishing a drive connection between said eccentric means and said input drive means.

36. A rock crusher comprising
(a) a base frame,
(b) a crusher head on said base frame,
(c) a bowl threadedly supported on said base frame whereby upon rotation thereof it is arranged to be raised or lowered,
(d) a plurality of projections secured in spaced relation around the periphery of said bowl,
(e) fluid cylinder means on said base frame having a piston rod operable adjacent to said projections,
(f) an elongated pawl member having opposite ends,
(g) said pawl member being pivotally connected intermediate its ends to said piston rod,
(h) first hook means on one end of said pawl member arranged for driving engagement with said projections,
(i) spring means urging said pawl means into engagement with said projections,
(j) second hook means on the other end of said pawl,
(k) and stop means on said base frame engageable by said second hook means in retracting movement of said piston rod and arranged to rotate said pawl member away from said projections against the action of said spring means in a retracted position of said piston rod wherein said first hook means is positioned for engaging a following one of said projections.

37. The rock crusher of claim 36 including a pair of said fluid cylinder means and associated pawl members operating in opposite directions so as to be capable of rotating said bowl in either direction.

38. A rock crusher comprising
(a) a base frame,
(b) a crusher head on said base frame,
(c) a bowl rotatably supported on said base frame whereby upon rotation thereof it is arranged to be raised or lowered,
(d) a plurality of projections secured in spaced relation around the periphery of said bowl,
(e) fluid cylinder means on said base frame having a piston rod operable adjacent to said projections,
(f) a pawl member operatively connected to said piston rod,
(g) means supporting said pawl member for radial movement relative to said bowl,
(h) said pawl member having an inner edge with notch means therein arranged for driving engagement with said projections in selected operations of said piston rod,
(i) and toggle linkage means operatively connected to said pawl member arranged to move said pawl member radially into and out of driving engagement with said projections.

39. The rock crusher of claim 38 wherein said inner edge of the pawl member has at least three notches arranged such that at least two of said notches will be in engagement with said projections at a time in a driving movement of said piston rod.

40. The rock crusher of claim 38 including a pair of said fluid cylinder means and associated pawl memners operating in opposite directions so as to be capable of rotating said bowl in either direction.

* * * * *

UNITED STATES PATENT AND TRADEMARK OFFICE

CERTIFICATE OF CORRECTION

PATENT NO. : 4,192,472

DATED : March 11, 1980

INVENTOR(S) : LOUIS W. JOHNSON

It is certified that error appears in the above-identified patent and that said Letters Patent are hereby corrected as shown below:

41.

A rock crusher comprising (a) a base frame, (b) a crusher head on said base frame, (c) a bowl on said frame associated with said head to form a crushing area, (d) eccentric means operable with said head to produce gyratory movement thereof upon rotation of said eccentric means, (e) support means on said bowl supported rotatably on said base frame, (f) said support means having vertically threaded connection with said bowl whereby upon rotation of said support means said bowl is arranged to be raised or lowered, (g) and bearing liner means between the threads of said bowl and said support means to reduce the unlocking force required to rotate said bowl.

UNITED STATES PATENT AND TRADEMARK OFFICE

CERTIFICATE OF CORRECTION

DATED :March 11, 1980

INVENTOR(S) LOUIS W. JOHNSON

It is certified that error appears in the above-identified patent and that said Letters Patent are hereby corrected as shown below:

42.

A rock crusher comprising (a) a base frame, (b) a crusher head on said base frame, (c) a mantle seated on said head, (d) a bowl on said frame associated with said mantle to form a crushing area, (e) shaft means having a top surface, (f) eccentric means operable with said shaft to produce gyratory movement upon rotation of said eccentric means, (g) a threaded recess in the top surface of said shaft means, (h) a threaded bushing removably engageable in said threaded recess and having inner threads, (i) a cap member arranged to bear down on said mantle to hold the latter down on said head, (j) and an integral depending shank on said cap

UNITED STATES PATENT AND TRADEMARK OFFICE

CERTIFICATE OF CORRECTION

PATENT NO. : 4,192,472

DATED : March 11, 1980

INVENTOR(S) : LOUIS W. JOHNSON

It is certified that error appears in the above-identified patent and that said Letters Patent are hereby corrected as shown below:

arranged for removable engagement with said inner threads to removably hold said cap down on said mantle.

Column 15, line 46, change "an outer" to --a--;

line 47, change "a" to --an outer--.

Column 17, line 1, change "rocker" to --rock--.

Column 20, line 39, change "memners" to --members--.

On the title page after the Abstract, "40 Claims" should read -- 42 Claims --.

Signed and Sealed this

Tenth Day of June 1980

[SEAL]

Attest:

SIDNEY A. DIAMOND

Attesting Officer

Commissioner of Patents and Trademarks